US008056351B2

(12) United States Patent
Marciano et al.

(10) Patent No.: US 8,056,351 B2
(45) Date of Patent: Nov. 15, 2011

(54) BLOWER FOR MARINE AIR CONDITIONER

(75) Inventors: Frank Marciano, Boca Raton, FL (US); Ronald Pabisz, Boynton Beach, FL (US)

(73) Assignee: Dometic Corporation, Elkhart, IN (US)

( * ) Notice: Subject to any disclaimer, the term of this patent is extended or adjusted under 35 U.S.C. 154(b) by 853 days.

(21) Appl. No.: 12/021,328

(22) Filed: Jan. 29, 2008

(65) Prior Publication Data

US 2008/0190120 A1 Aug. 14, 2008

Related U.S. Application Data

(60) Provisional application No. 60/889,120, filed on Feb. 9, 2007.

(51) Int. Cl.
*B63B 25/26* (2006.01)
*B60H 1/32* (2006.01)

(52) U.S. Cl. ..... 62/240; 62/239

(58) Field of Classification Search ..... 62/238.6, 62/286, 298, 427, 239–240, 259.1; 285/243, 285/365, 366, 407, 410, 411, 424
See application file for complete search history.

(56) References Cited

U.S. PATENT DOCUMENTS

| | | | | | |
|---|---|---|---|---|---|
| 2,185,387 | A * | 1/1940 | Welland et al. | 62/427 |
| 3,364,989 | A * | 1/1968 | Marsteller | 165/122 |
| 3,760,601 | A * | 9/1973 | Bunten | 62/240 |
| 3,888,090 | A * | 6/1975 | Meyer | 62/240 |
| 4,437,320 | A * | 3/1984 | Eklund | 62/236 |
| 4,930,815 | A * | 6/1990 | Tuggler, Jr. | 285/142.1 |
| 5,444,900 | A * | 8/1995 | Shawhan et al. | 27/19 |
| 5,848,536 | A * | 12/1998 | Dodge et al. | 62/240 |
| 6,101,829 | A * | 8/2000 | Robinson | 62/259.1 |
| 2005/0092016 | A1 * | 5/2005 | Ozaki | 62/419 |
| 2005/0236013 | A1 * | 10/2005 | Huston et al. | 134/1 |

* cited by examiner

*Primary Examiner* — Frantz Jules
*Assistant Examiner* — Emmanuel Duke
(74) *Attorney, Agent, or Firm* — Pearne & Gordon LLP

(57) ABSTRACT

An air conditioning system for a nautical vehicle includes a main body including an assembly, and a blower including an inlet and an outlet, the inlet being in air communication with the main body, the blower further including blades rotating therewithin about a first axis, the assembly for adjusting the blower with respect to the main body about a second axis so as to alter an orientation of the outlet. The assembly includes a guiding cover and a cylindrical duct element for maintaining the main body and the blower in air communication with one another. The duct element has a first base and a second base, and is coupled to the blower at the second base. The first base of the duct element is dimensioned to correspondingly fit the guiding cover, and the duct element is rotatably adjustable around the guiding cover about the second axis at the first base.

23 Claims, 30 Drawing Sheets

BLOWER FOR MARINE AIR CONDITIONER

CROSS-REFERENCE TO RELATED APPLICATIONS

This application claims the benefit of U.S. Provisional Application No. 60/889,120, filed Feb. 9, 2007, the entire disclosure of which is hereby incorporated herein by reference.

FIELD OF THE INVENTION

The present invention relates generally to air conditioners and, more particularly, to air conditioners for nautical vehicles.

BACKGROUND OF THE INVENTION

The installation of an air conditioning system in a nautical vehicle must make use of the limited space available in the vehicle. Generally, the installation location will be determined based on factors, such as plumbing or ductwork surrounding the system, and the manner in which the system is installed such as orientation and room for placement. An air conditioning system equipped with features that allow for easy installation is necessary for situations where it must be installed in limited space obstructed by surrounding objects.

SUMMARY OF THE INVENTION

Accordingly, it is an aspect of the present invention to eliminate problems and shortcomings of conventional air conditioning systems in nautical vehicles.

In accordance with one aspect of the present invention, an air conditioning system for a nautical vehicle includes a main body, a blower and an assembly. The blower includes an inlet and an outlet, and the inlet is in air communication with the main body. The blower further includes blades rotating therewithin about a first axis, and the assembly is for adjusting the blower with respect to the main body about a second axis so as to alter an orientation of the outlet.

In accordance with another aspect of the present invention, the first and second axes are substantially parallel.

In accordance with still another aspect of the present invention, the first and second axes are identical.

In accordance with still another aspect of the present invention, the blower is a centrifugal fan.

In accordance with still another aspect of the present invention, the assembly includes a guiding cover and a cylindrical duct element for maintaining the main body and the blower in air communication with one another. The duct element has a first base and a second base, and is coupled to the blower at the second base. The first base of the duct element is dimensioned to correspondingly fit the guiding cover. The duct element is rotatably adjustable around the guiding cover about the second axis at the first base.

In accordance with still another aspect of the present invention, the bases are circular and the duct element is slidingly adjustable around the guiding cover about the second axis.

In accordance with still another aspect of the present invention, the bases are non-circular and the duct element is non-slidingly adjustable around the guiding cover about the second axis.

In accordance with still another aspect of the present invention, the first and second bases have unequal surface areas.

In accordance with still another aspect of the present invention, the duct element is substantially tapered toward the blower.

In accordance with still another aspect of the present invention, the duct element can be axially divided into a tapered portion and a non-tapered portion, and a clamp element is placed around the non-tapered portion.

In accordance with still another aspect of the present invention, the clamp element is configured to have a variable perimeter for fastening the duct element to the guiding cover.

In accordance with still another aspect of the present invention, the orientation of the blower is altered by loosening and tightening of the clamp element.

In accordance with still another aspect of the present invention, the blower is installed with respect to the duct element in such a way that the maximum height of the air conditioning device is limited.

In accordance with still another aspect of the present invention, the non-tapered portion includes peripherally scattered indents to accommodate elastic deformation of the non-tapered portion when the clamp element is placed.

In accordance with still another aspect of the present invention, the duct element includes an outwardly projecting flange at the first base. The flange includes a peripherally located pass portion, and the main body further includes a first engaging element and a second engaging element. The flange of the duct element is removably held by the first and second engaging elements, and the duct element is removed by rotating the duct element so that one of the engaging elements can pass through the pass portion.

In accordance with still another aspect of the present invention, the duct element includes protrusions that are located peripherally on the non-tapered portion so that the clamp element can be secured between the flange and the projections.

In accordance with still another aspect of the present invention, the pass portion allows removal of the duct element from the main body only at a predetermined orientation of the duct element.

In accordance with still another aspect of the present invention, the predetermined orientation is indicated by the alignment of a first marking and a second marking.

In accordance with still another aspect of the present invention, an air conditioning device for a nautical vehicle includes a main body and a blower. The blower includes an inlet and an outlet, and the inlet is in air communication with the main body. The blower is rotatable about an axis so that the outlet can be oriented toward a first direction and a second direction. The first and second directions point to substantially different lateral sides of the main body.

In accordance with still another aspect of the present invention, the first direction and the second direction point to substantially opposite directions.

In accordance with still another aspect of the present invention, the blower can be rotated without interference from the compressor, the evaporator and the condenser.

In accordance with still another aspect of the present invention, the blower is rotatable by more than 270 degrees.

In accordance with still another aspect of the present invention, the air conditioning device further includes a clamp element for maintaining the blower oriented with respect to the main body, and only loosening and tightening of the clamp element is necessary to change orientation of the blower.

In accordance with still another aspect of the present invention, a method of installing an air conditioning device is provided. The air conditioning device includes a main body, the blower and a clamp element. The blower includes an outlet and is rotatable about an axis. The method includes the steps of orienting the outlet of the blower to a desired direction by hand through rotation about the axis, and tightening the clamp element to maintain the blower oriented with respect to the main body.

In accordance with still another aspect of the present invention, a method of adjusting an air conditioning device is provided. The air conditioning device includes a main body, the blower and a clamp element. The blower includes an outlet and is rotatable about an axis. The method includes the steps of loosening the clamp element, orienting the outlet of the blower to a desired direction by hand through rotation about the axis, and tightening the clamp element to maintain the blower oriented with respect to the main body.

In accordance with still another aspect of the present invention, a drain pan for an air conditioning system includes an integral base portion, an integral wall portion and a drainage area. The integral base portion has a mounting surface defining a first elevation. The integral wall portion encircles the base portion peripherally. The drainage area includes a dimple and a receptacle. The dimple is located peripherally on the base portion and defines a second elevation. The receptacle is located externally on the wall portion near the dimple and is adapted to be perforated by a drain fitting thereby allowing access to the dimple. The first elevation is above the second elevation.

In accordance with still another aspect of the present invention, the base portion further includes a trough adapted to route condensate to the drainage area and the trough defines a third elevation. The third elevation is above the second elevation but below the first elevation.

In accordance with still another aspect of the present invention, the drain pan includes multiple drainage areas only one receptacle of which is perforated to channel condensate flow to the selected drainage area.

In accordance with still another aspect of the present invention, the receptacle includes a tapered portion allowing threaded connection for the drain fitting.

In accordance with still another aspect of the present invention, the base portion is sloped downward to channel condensate into the trough.

In accordance with still another aspect of the present invention, the drain pan is formed by molding.

In accordance with still another aspect of the present invention, the receptacle is perforated by knocking out a part of the wall portion using the drain fitting.

In accordance with still another aspect of the present invention, an air conditioning system includes a drain pan, a compressor, an evaporator, a condenser defined by a loop of coil and a blower. The evaporator and the condenser are mounted in a substantially vertical manner.

In accordance with still another aspect of the present invention, the air conditioning system further includes a reversing valve located at least partially within the loop.

In accordance with still another aspect of the present invention, the condenser and the evaporator are mounted next to one another, and the evaporator includes end plates for securing the condenser to the evaporator.

In accordance with still another aspect of the present invention, the drain pan includes an integral pedestal on which the condenser can be fittingly placed.

In accordance with still another aspect of the present invention, the drain pan includes posts projecting from the drain pan to fittingly place the evaporator thereby stabilizing the vertical mounting of the evaporator.

In accordance with still another aspect of the present invention, the compressor occupies a first mounting area above the drain pan, the evaporator occupies a second mounting area above the drain pan, the condenser occupies a third mounting area above the drain pan, and the drain pan is dimensionally limited so as to substantially span only the first, second and third mounting areas.

In accordance with still another aspect of the present invention, the compressor is mounted to the drain pan through a vibration-reducing mounting assembly.

In accordance with still another aspect of the present invention, an aperture for the mounting assembly includes a rib to prevent a hex cap screw of the mounting assembly from falling out.

In accordance with still another aspect of the present invention, the drain pan includes an integral foot for maintaining balance.

In accordance with still another aspect of the present invention, the drain pan includes an integral handle for transporting the drain pan.

In accordance with still another aspect of the present invention, the drain pan includes apertures for resting pads adapted to reduce vibration from the system.

In accordance with still another aspect of the present invention, the drain pan includes a wall portion and is held in place on a surface through mounting clip assemblies engaging the wall portion and movable around the perimeter of the drain pan.

In accordance with still another aspect of the present invention, the mounting clip assemblies comprise an engaging clip and a support.

In accordance with still another aspect of the present invention, the base has vibration absorbing means.

In accordance with still another aspect of the present invention, an air conditioning system includes a drain pan, a compressor, an evaporator, a condenser, a blower and a shroud structure. The compressor occupies a first mounting area. The evaporator has an inlet and an outlet and occupies a second mounting area. The condenser is defined by a loop of coil and is located adjacent the inlet. The condenser occupies a third mounting area. The blower is located adjacent the outlet. The shroud structure houses the compressor, the evaporator and the condenser. The shroud structure includes an opening adjacent the condenser so that air enters the inlet after passing substantially through the loop.

In accordance with still another aspect of the present invention, the shroud structure comprises a first cover, a second cover and a third cover, a first cover houses the evaporator and the condenser, a second cover houses a part of the compressor, and a third cover houses the rest of the compressor.

In accordance with still another aspect of the present invention, the first cover is configured as a return air plenum.

In accordance with still another aspect of the present invention, the second cover and the third cover include noise-reducing means.

In accordance with still another aspect of the present invention, the condenser is a tube-in-tube structure, an outer tube channeling refrigerant and an inner tube channeling water, and the shroud structure is shaped to accommodate incoming and outgoing water tubes in fluid communication with the condenser.

BRIEF DESCRIPTION OF THE DRAWINGS

The foregoing and other aspects of the present invention will become apparent to those skilled in the art to which the present invention relates upon reading the following description with reference to the accompanying drawings, in which:

FIGS. 30A-1 and 30A-2 are schematic illustrations of a first example embodiment of the duct element.

FIGS. 30B-1 and 30B-2 are schematic illustrations of a second example embodiment of the duct element.

FIGS. 30*c*-1 and FIGS. 30C-2 are schematic illustrations of a third example embodiment of the duct element.

DETAILED DESCRIPTION OF EXAMPLE EMBODIMENTS

Figure 1:
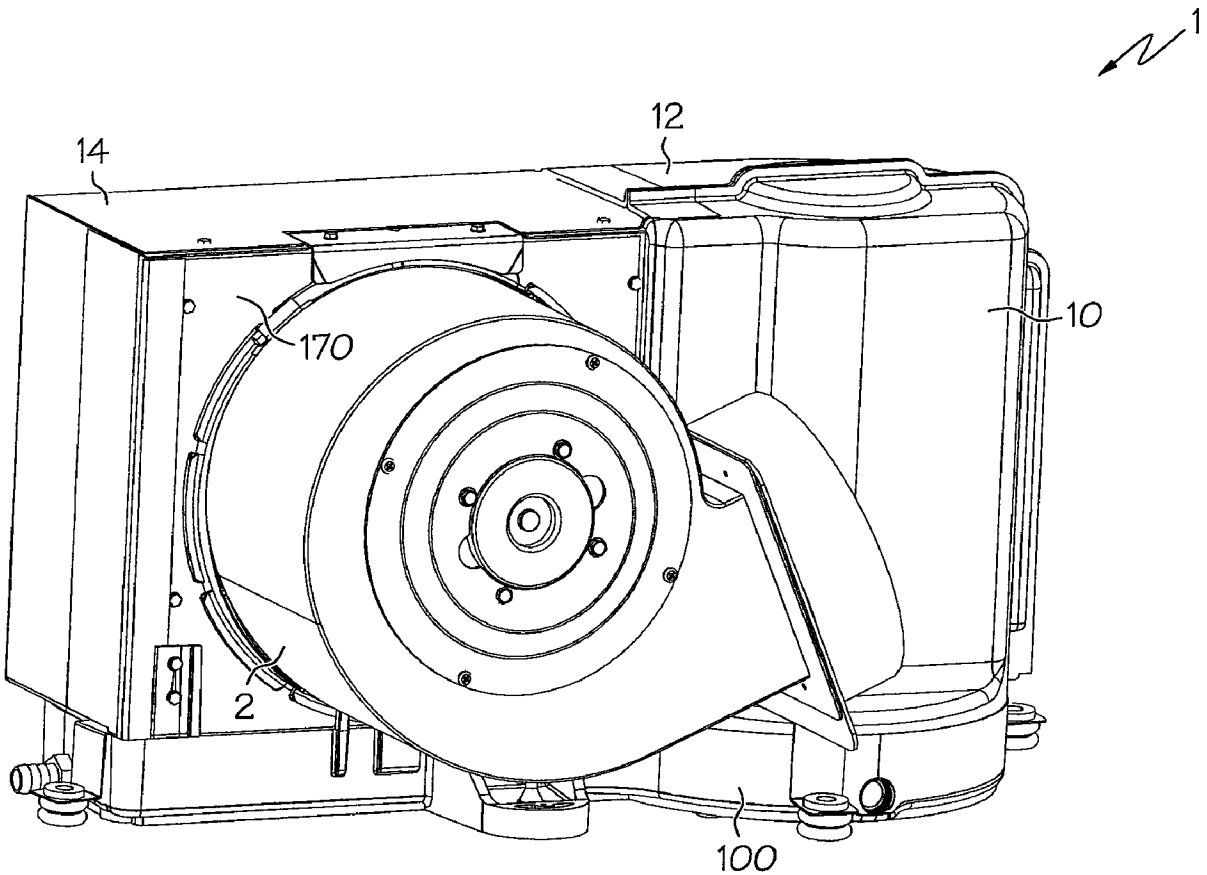
FIG. 1 is a first perspective view of an example embodiment of an air conditioner with a blower incorporating aspects of the present invention.

Example embodiments that incorporate one or more aspects of the present invention are described and illustrated in the drawings. These illustrated examples are not intended to be limitations on the present invention. For example, one or more aspects of the present invention can be utilized in other embodiments and even other types of systems.

The terms "air conditioner" or "air conditioning" will be used to encompass any treatment of air including heating and cooling and may include heat pumps but also other HVAC systems. Air conditioning is also meant to encompass both indoor air conditioning, which is limited to the air conditioning of an enclosed area and outdoor air conditioning, which occurs in the open air. Moreover, the present invention is primarily designed for use in a nautical vehicle but obvious alterations are within the scope of the present invention and will have use in other applications such as conventional vehicles, recreational vehicles, aircrafts or other means of transportation and also in means of habitation.

Figure 2:
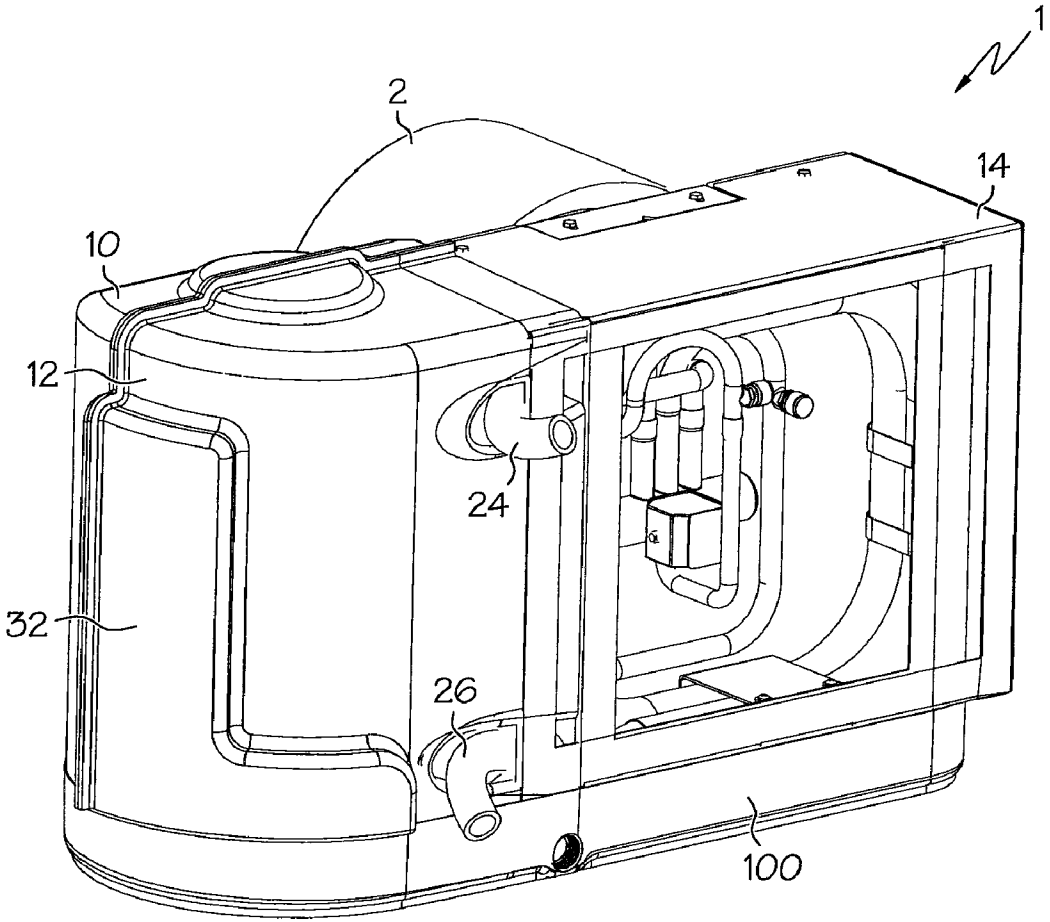
FIG. 2 is a second perspective view of the air conditioner.
Figure 3:
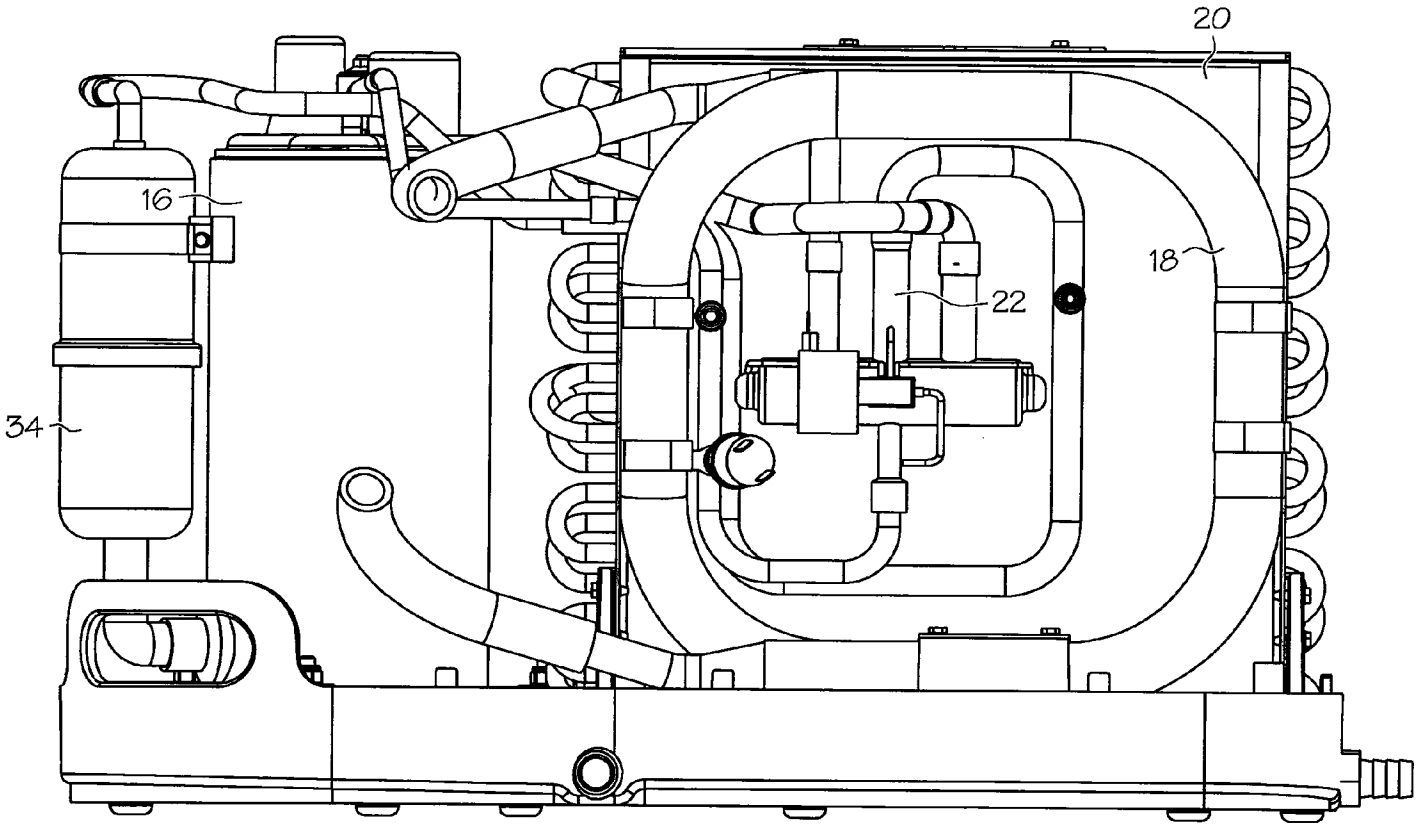
FIG. 3 is a front view of the air conditioner without covers.
Figure 4:
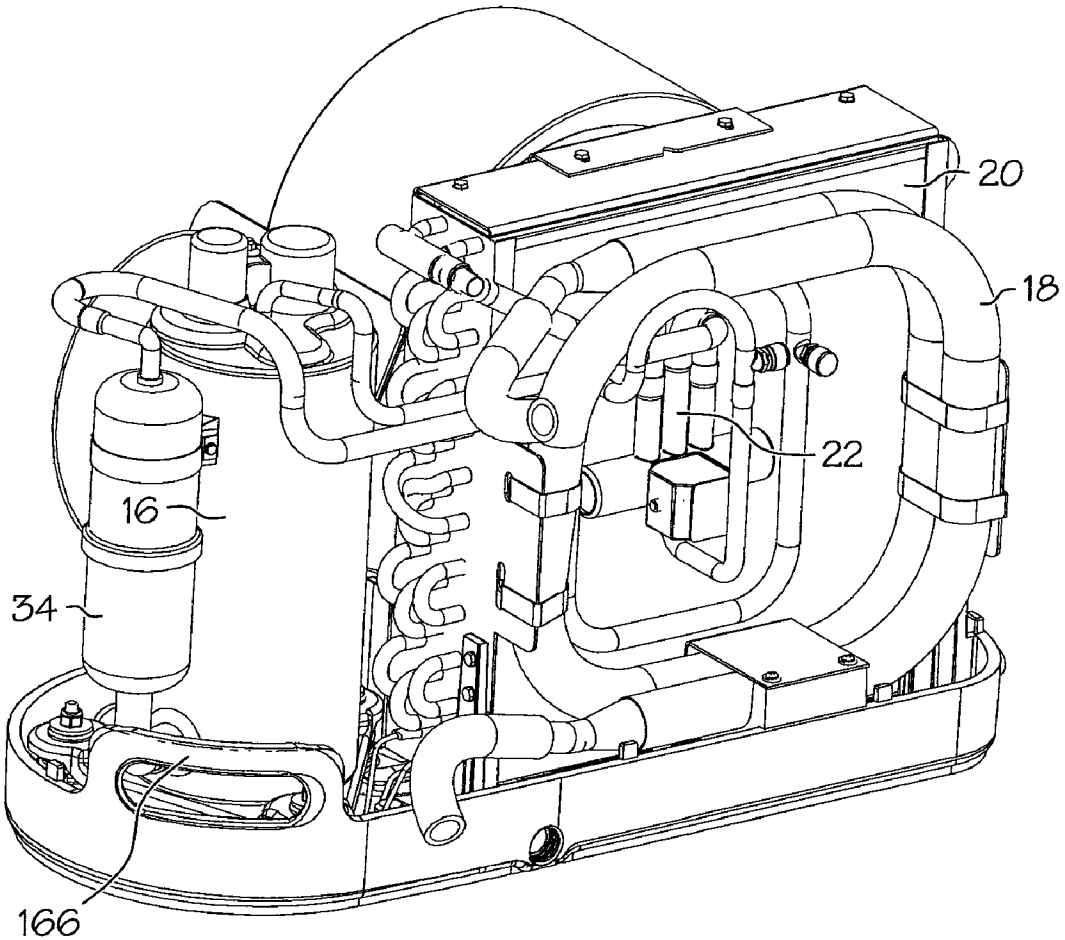
FIG. 4 is a perspective view of the air conditioner without the covers.

FIGS. 1-2 show an air conditioner 1 according to an embodiment of the present invention. In this embodiment, the exterior of the air conditioner primarily comprises a drain pan 100 or base pan, a blower 2, and a shroud structure (FIG. 5) composed of a supply side cover 10, a return side cover 12 and a heat exchanger cover 14. The interior of the air conditioner 1 primarily comprises a compressor 16, a condenser 18, an evaporator 20 and a reversing valve 22 as shown in FIGS. 3-4.

This embodiment shows a self-contained type air conditioner in which the major components of a refrigeration cycle are present. However, alternative embodiments may leave out some of these major components and still come within the scope of the present invention. For example, it is possible to install the compressor and the condenser at a remote location and to simply have an embodiment in which only the blower and the evaporator are present among the major components of a refrigerating cycle with the dimensions of the drain pan 100 reduced accordingly.

Figure 5:
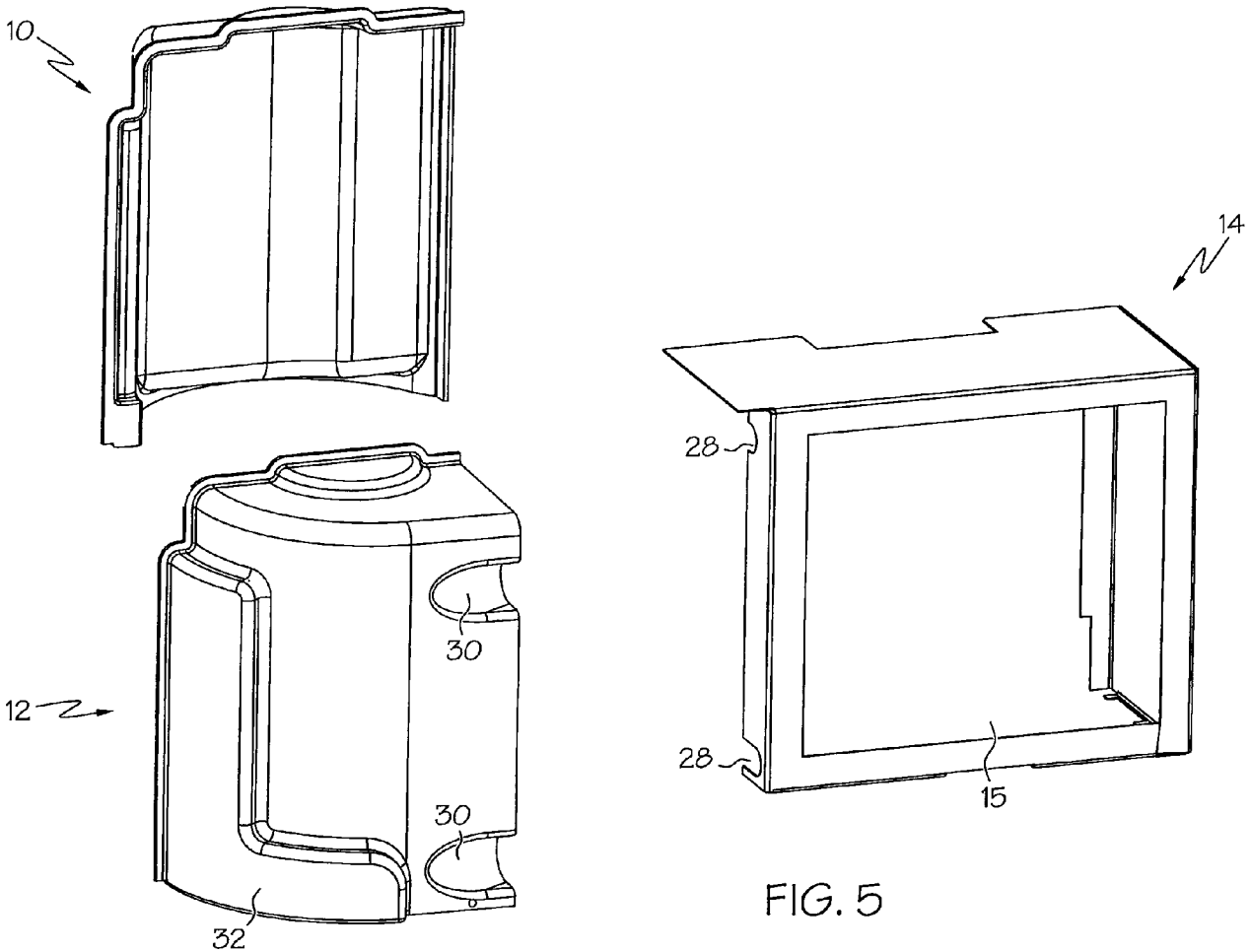
FIG. 5 is a perspective view of the covers.

The covers 10, 12 and 14 of the air conditioner 1 are easily removable for access to the components, and the heat exchanger cover 14 encloses the evaporator 20 and the condenser 18 while the supply side cover 10 and the return side cover 12 enclose the compressor 16 (FIGS. 1-2). The covers 10, 12, 14, shown in their removed state in FIG. 5, are molded to suit the shape of the components of the air conditioner and to reduce or minimize the volume of the air conditioner. In this embodiment, the heat exchanger cover 14 is substantially rectilinear but it may instead have curved surfaces similar to the supply side cover 10 and the return side cover 12. The heat exchanger cover 14 includes an inlet 15 that is in air communication with a return air duct (not shown) that channels air to the air conditioner 1. In this manner, the heat exchanger cover 14 can operate as a return air plenum. The heat exchanger cover 14 is substantially hexahedral and is composed of three orthogonally adjacent surfaces. The heat exchanger cover 14 does not enclose the supply air side, near which the blower 2 is located, to accommodate for the presence of the blower 2 and to allow removal of the heat exchanger cover 14 without detachment the blower 2. The paths of water tubes 24, 26 (FIG. 2), which are in fluid communication with the condenser 18 and channel water to and from an external water source, are accommodated through indented portions 28 of the heat exchanger cover 14 and depressions 30 on the return side cover 12, as shown in FIGS. 2 and 5. The molded shape of the return side cover 12 and the supply side cover 10 are configured to correspond to the shape of compressor 16. In particular, bulging portions 32 (FIGS. 2 and 5) of the return side cover 12 and the supply side cover 10 accommodate an accumulator 34 (FIGS. 3 and 4) of the compressor 16 whose location with respect to the compressor 16 can change depending on the type or brand of compressor 16 used.

Accordingly, the return side cover 12 and the supply side cover 10 can accommodate various types of compressor models within a compact space. Furthermore, as will be discussed later and shown in FIGS. 1 and 5, the supply side cover 10 is shaped to accommodate and reduce interference with the rotation of the blower 2.

The shroud structure may include noise-reducing means to reduce noise emanating from the air conditioning components such as the compressor 16. In this embodiment, the supply side cover 10 and the return side cover 12 may include such noise-reducing means. The noise-reducing means can comprise a particular type of paint, foam, padding or the like applied on the interior of the covers 10 or 12.

The shapes or number of covers in this embodiment should not be deemed as limitations, and variations in the covers are also encompassed by the present invention. For example, it may be possible to have one integral cover instead of the three used in this embodiment and the covers could either be substantially rectilinear or curved.

Figure 6:
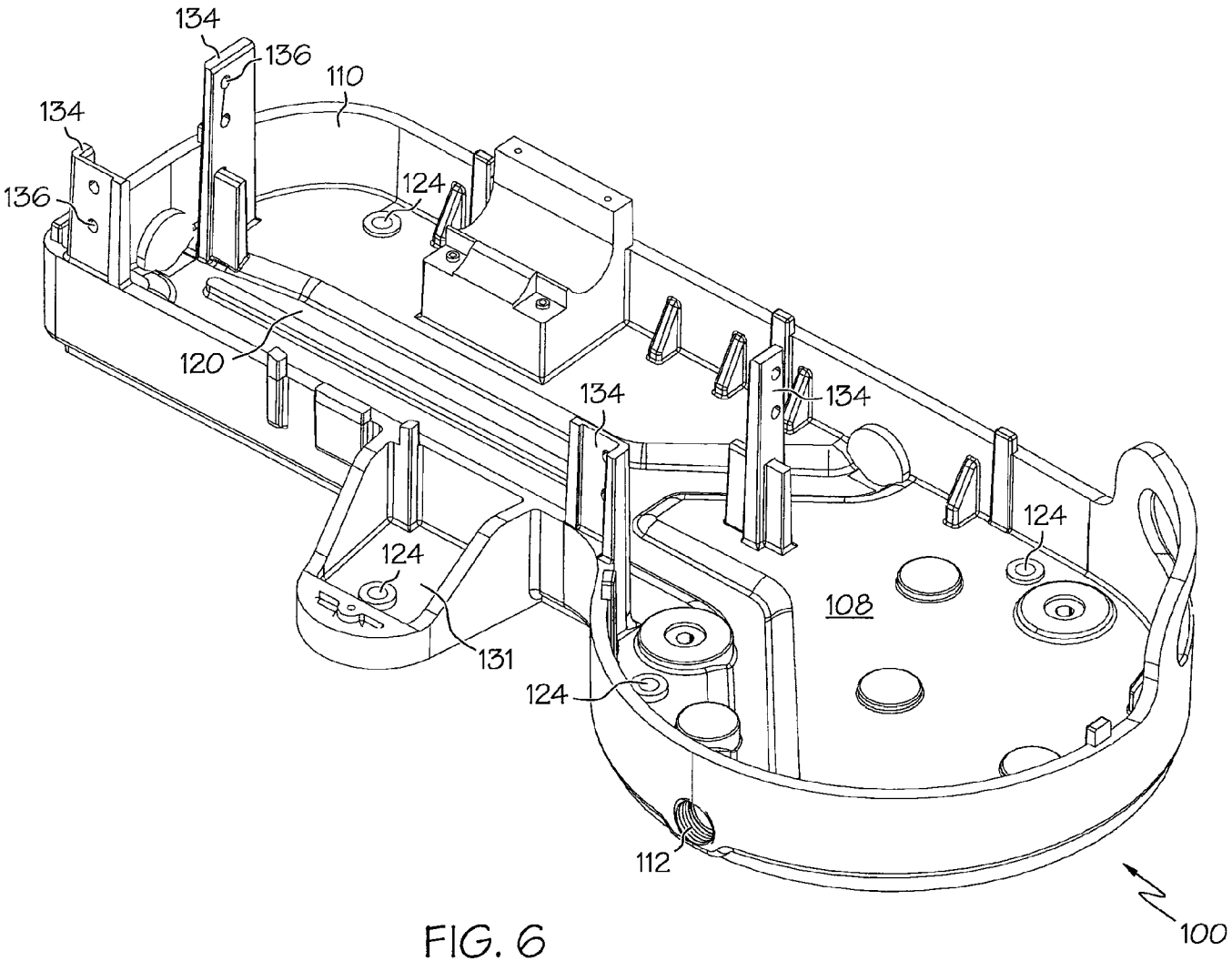
FIG. 6 is a first perspective view of a drain pan.
Figure 7:
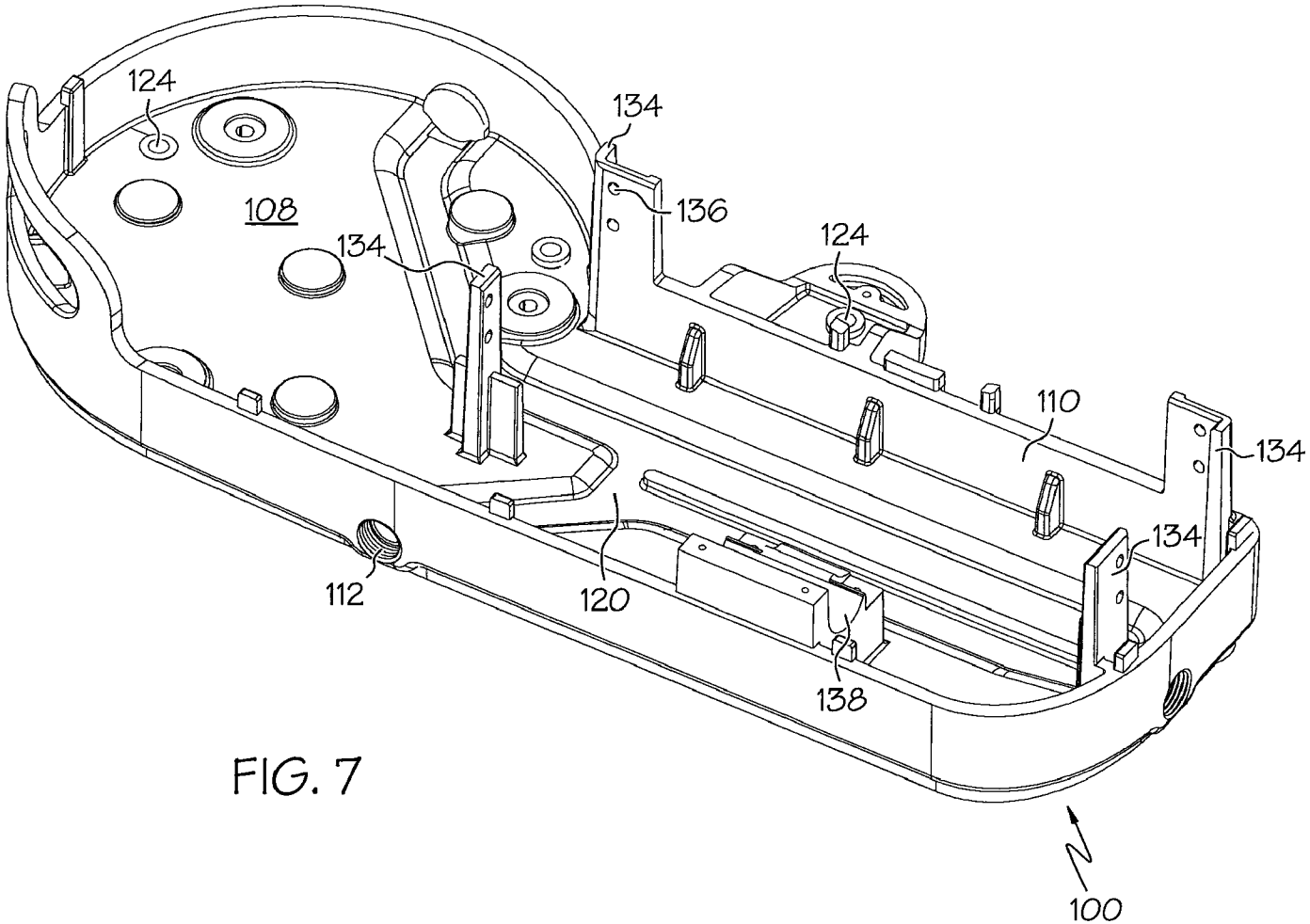
FIG. 7 is a second perspective view of the drain pan.
Figure 8:
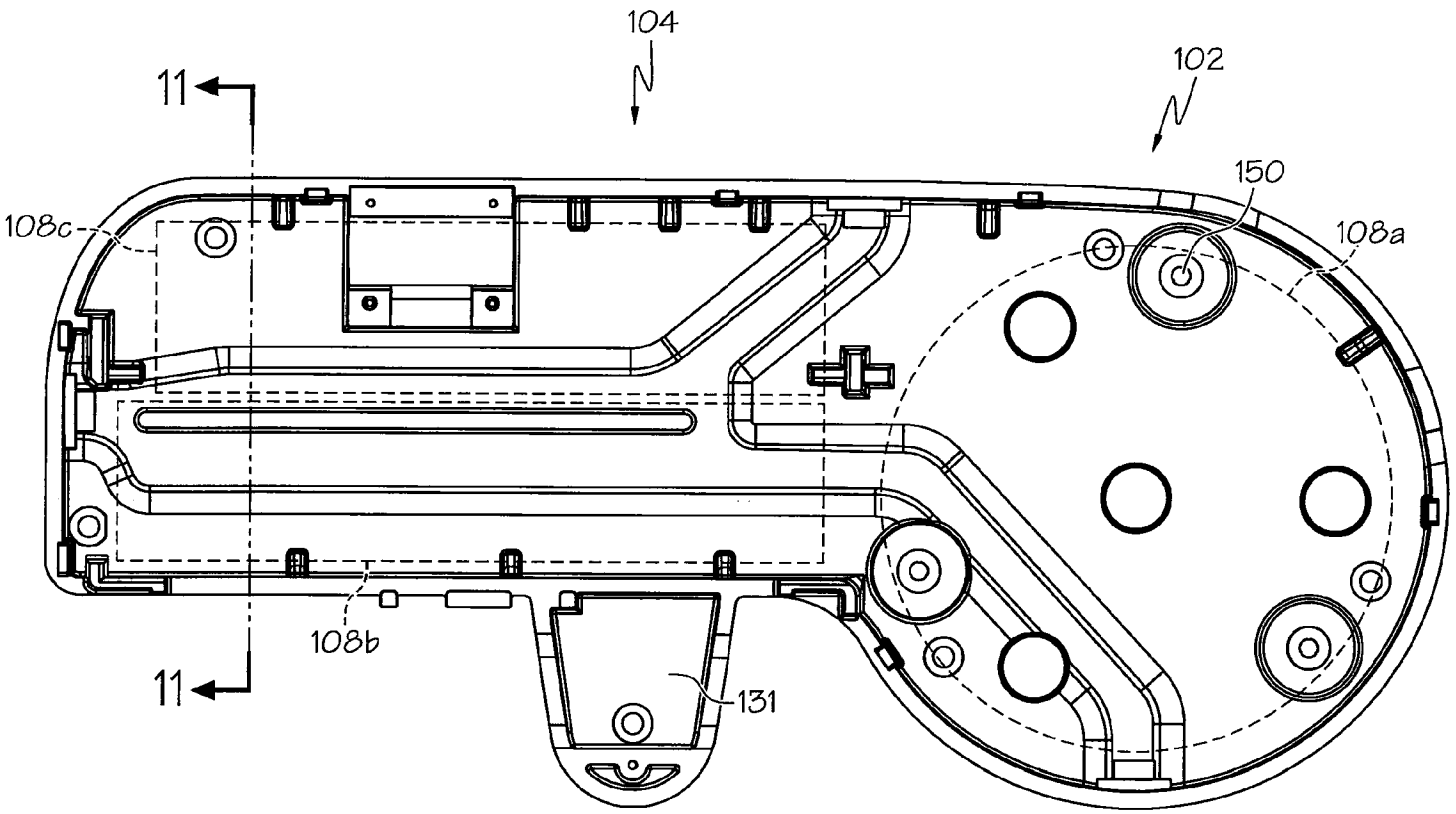
FIG. 8 is a top view of the drain pan indicating mounting areas for air conditioner components.
Figure 9:
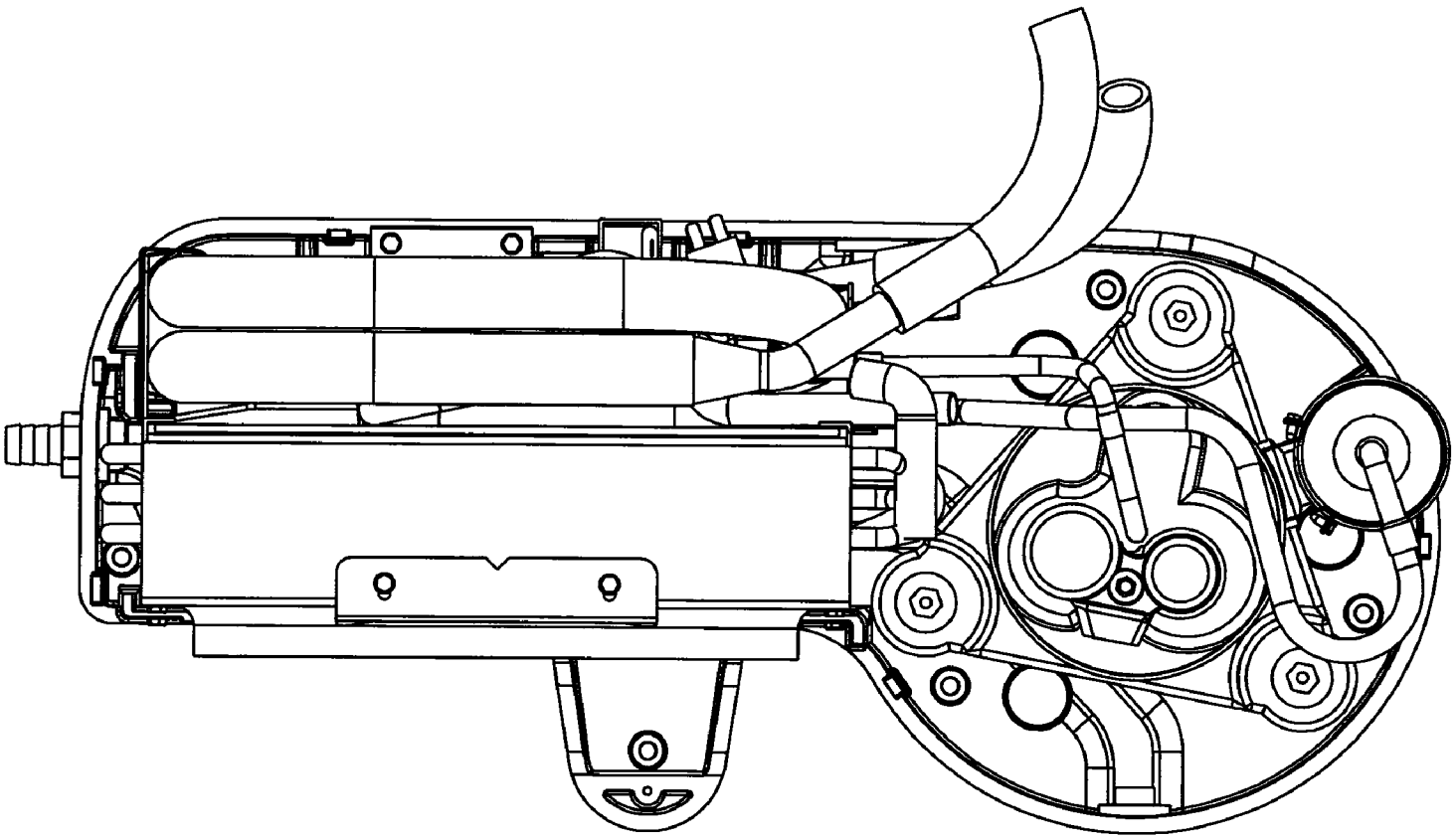
FIG. 9 is a top view of the air conditioner without the covers.
Figure 10:
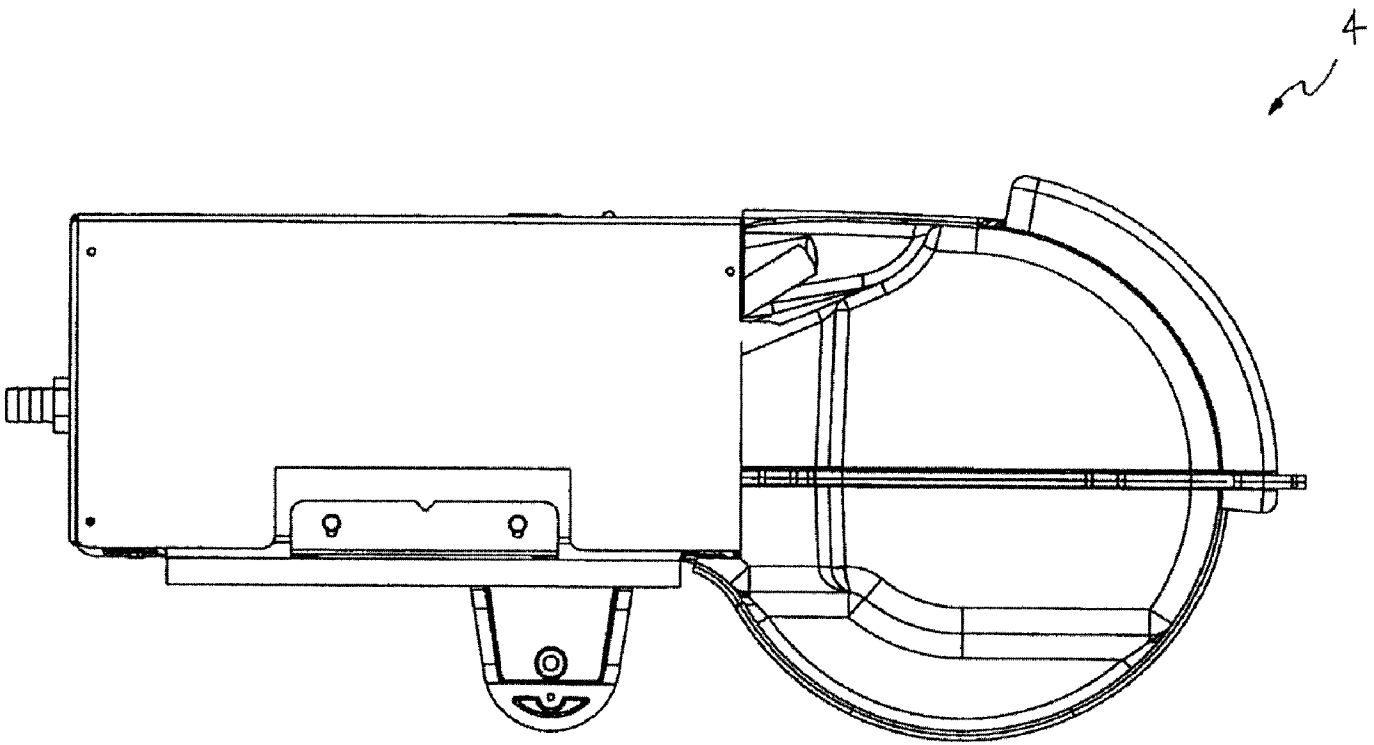
FIG. 10 is a top view of the air conditioner with the covers.
Figure 12:
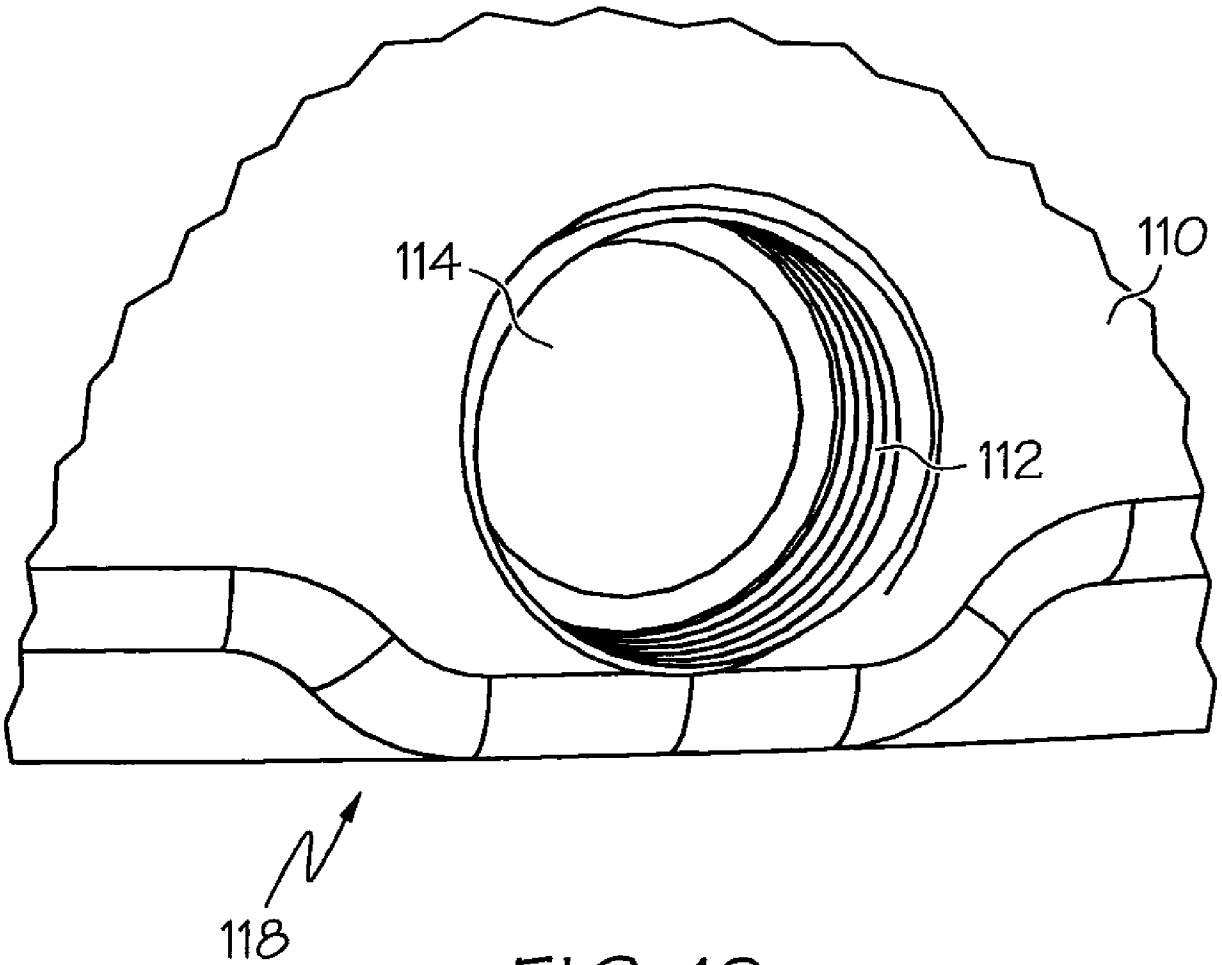
FIG. 12 is a close-up view of a receptacle of the drain pan.
Figure 13:
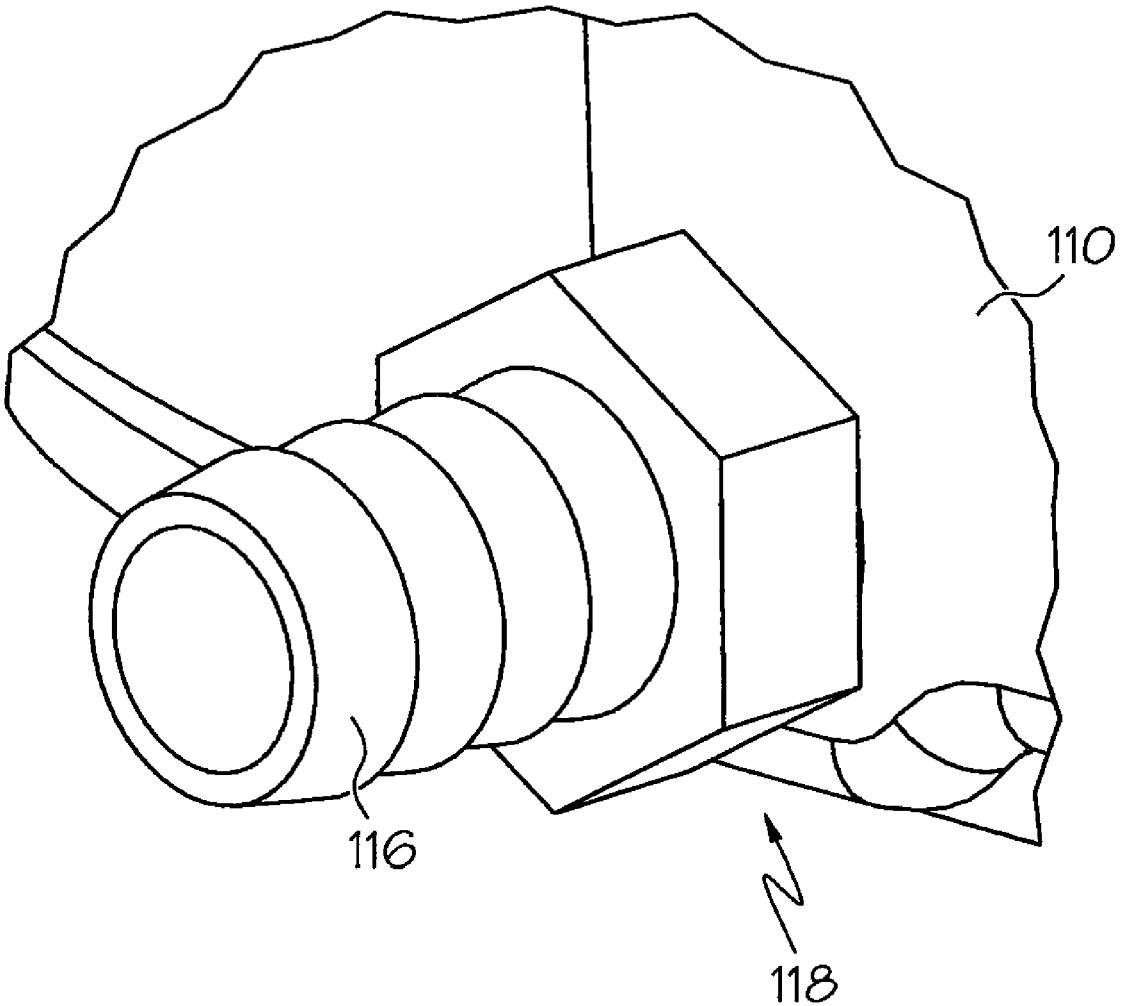
FIG. 13 is a close-up view of a drain fitting inserted in a receptacle of the drain pan.

FIGS. 6-8 show a molded drain pan 100 from which the air conditioning components have been removed. The drain pan 100 can be made of corrosion-resistant material such as composites and is molded to include features for accommodating the components described below. The overall footprint of the drain pan 100 can have various shapes and, in the present embodiment, takes on a key-like shape with a substantially circular portion 102 and a substantially rectangular portion 104, as shown in FIG. 8. As shown in FIGS. 9-10, the footprint of the drain pan 100 is designed to take up as little area as possible and offer versatility in installation while providing a foundation for the air conditioning components. A base portion of the drain pan 100 includes a mounting surface 108 while an integral, vertical wall portion 110 of the drain pan 100 substantially delineates its area and is molded to include tapered and threaded receptacles 112 (FIGS. 6, 7 and 12). As shown in FIGS. 12-13, the receptacles 112 are located on the external side of the wall portion 110 and have a thin backing wall 114 that becomes perforated when drain fittings 116 are screwed into thereby forming drainage areas 118. For example, the thin backing wall 114 can be configured so as to be easily knocked out from the vertical wall portion 110 when pressure is applied by inserting the drain fitting 116 or by using a tool. In this way, a user can install the drain fittings 116 at selected locations suitable to the drainage plumbing around the air conditioner 1 and can leave out any drain fitting 116 or equivalent structure that hinders with surrounding structures. Thus, the user need not utilize all of the receptacles 112. As a result, the air conditioner 1 can be oriented in any direction and still establish fluid communication with the surrounding drainage plumbing with gravity driven flow.

Figure 11:
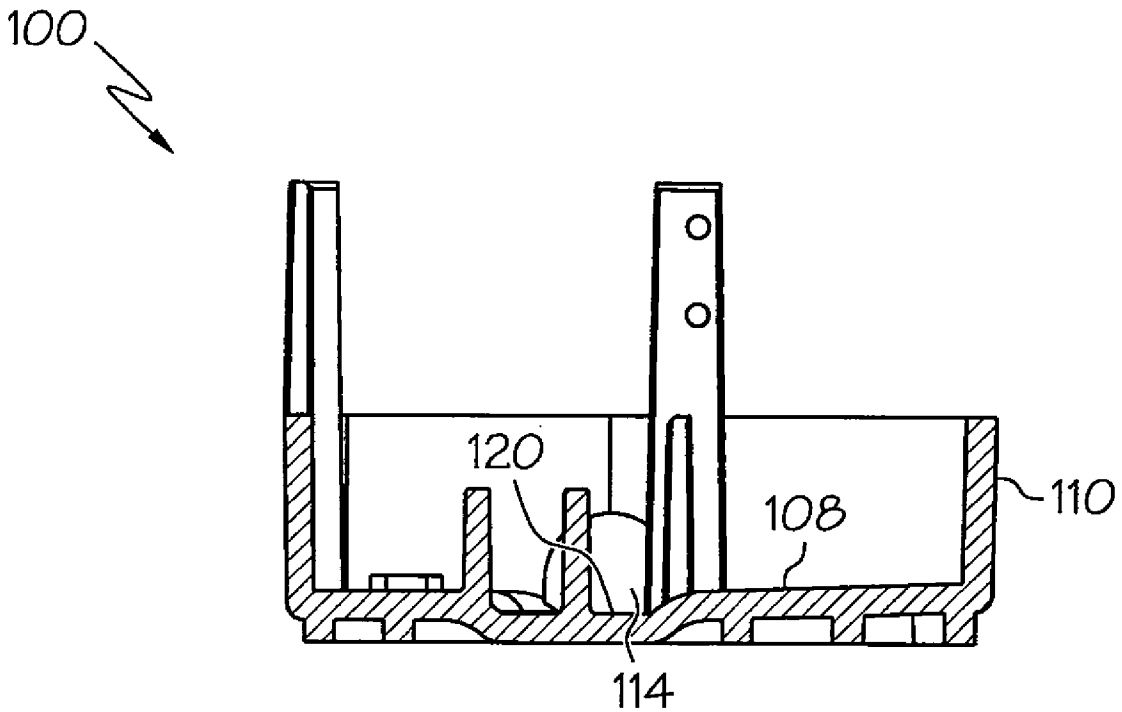
FIG. 11 is a sectional view of the drain pan along line 11 of FIG. 8.
Figure 14:
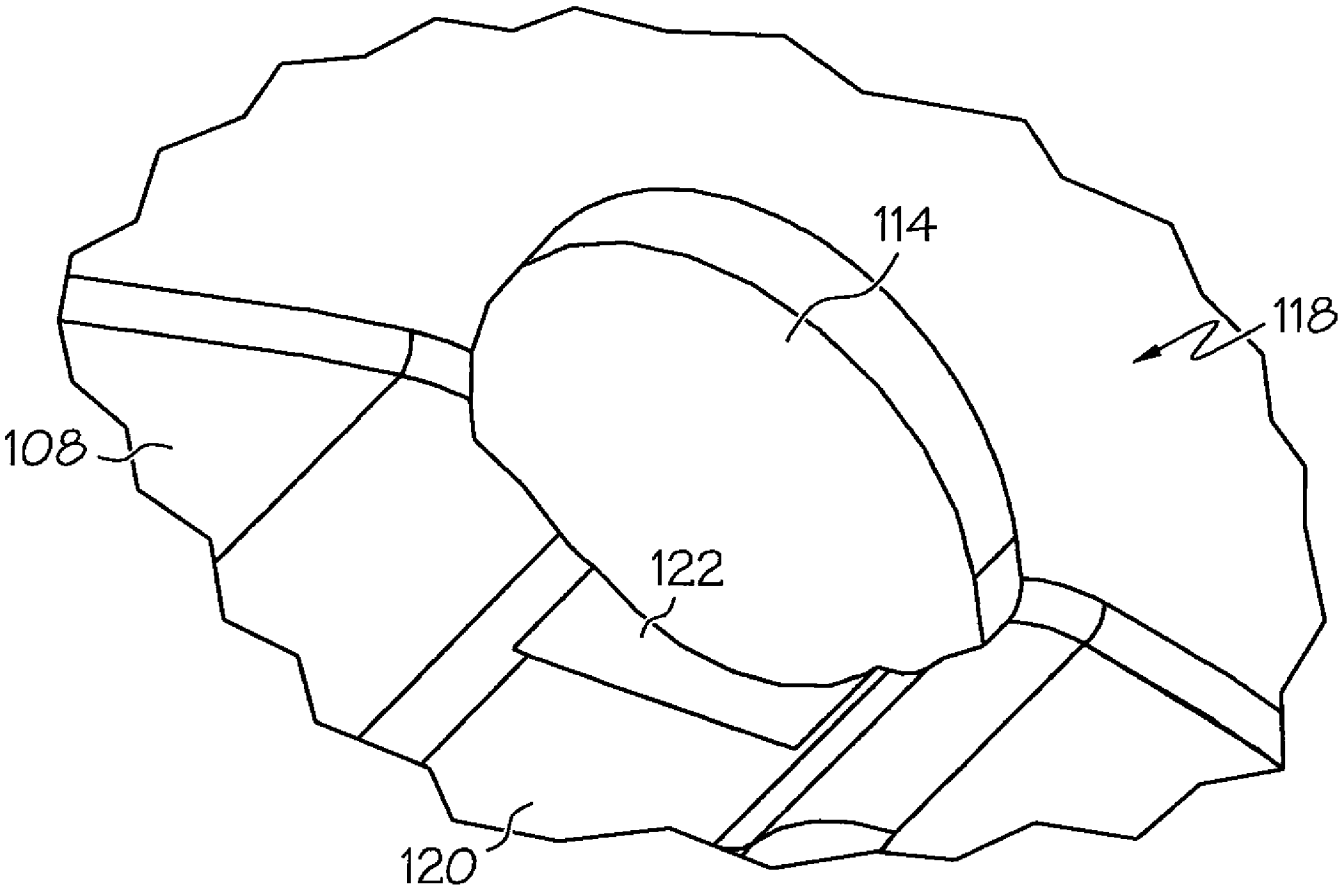
FIG. 14 is a close-up view of a dimple and a backing wall of the drain pan.

As seen in FIGS. 11 and 14, the mounting surface 108 of the drain pan 100 is sloped so that condensate water will be channeled from the mounting surface 108 to a trough 120 and then out to the drainage areas 118. In this embodiment, the trough 120 is level so that water can flow to any of the drainage areas 118. As shown in FIG. 14, the trough 120 terminates at the drainage areas 118 with dimples 122 which are substantially semi-cylindrical in shape and are located adjacent to backing wall 114. The dimples 122 accept the drain fittings 116 after they punch a hole in the receptacle 112 via screw-in (FIG. 13). In descending order of elevation, the mounting surface 108 is the highest, then the trough 120 and the dimple 122 as shown in FIG. 14. As seen in FIG. 11, the mounting surface 108 may be sloped downward to direct condensate into the trough 120. The drain fittings 116 can be of any material that is corrosion-resistant and sufficiently rigid to accomplish perforation of the receptacles 112. The dimples 122 allow the drain fittings 116 to be installed lower than conventional drain fittings which conventionally have to be above the mounting surface 108 of the drain pan 100 in order to accommodate a nut (not shown) engaging the drain fitting 116. The lower position of the drain fittings 116 contributes to quicker disposal of collected water and results in fewer components being in contact with water or the components being in contact with water for a shorter duration because the amount of water in the drain pan 100 is minimized. The drain pan 100 may accomplish drainage using variations in arrangement, number, and shape of features such as the trough 120, the drainage areas 118, the slope of the mounting surface 108 or the footprint of the drain pan 100.

Figure 15B:
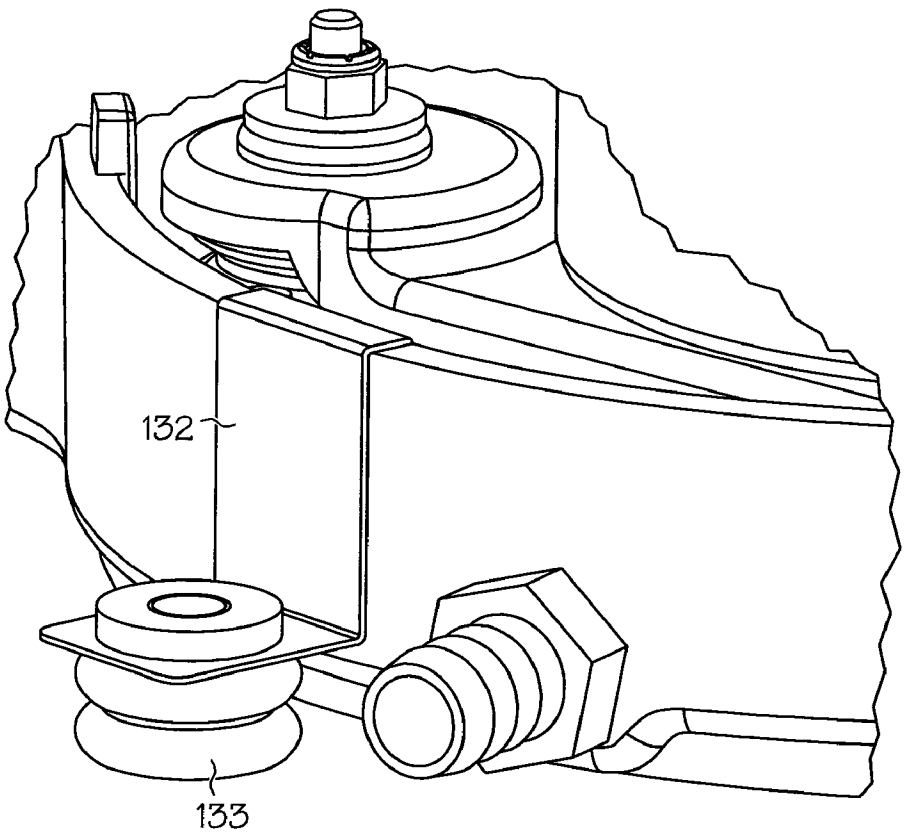
FIG. 15B is a close-up view of a mounting clip assembly engaging a wall portion of the drain pan.
Figure 15A:
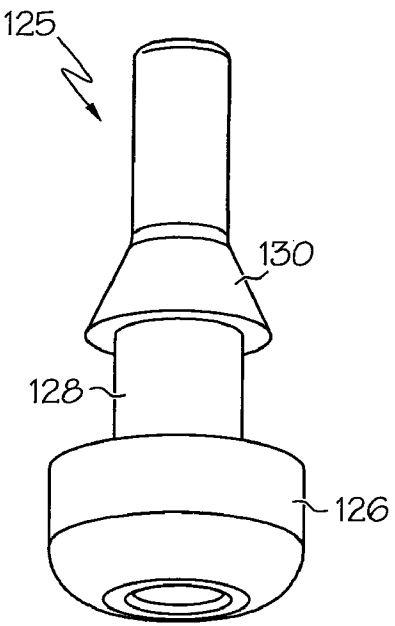
FIG. 15A is a close-up view of a resting pad.

In this embodiment, the drain pan 100 is further molded to include a plurality of apertures 124 (FIGS. 6-7) for accepting resting pads 125 (FIG. 15). The resting pad 125 in the present embodiment is a grommet that is substantially shaped like a bolt and is made of elastic material such as rubber. As shown in FIG. 15, a base section 126 of the resting pad 125 supports the drain pan 100 above an installation surface after assembly and has a hollow section in the middle to isolate the air conditioner. The purpose of the resting pads 125 is to dampen the vibration that is caused by the compressor 16 and the blower 2 and that can be transmitted through the drain pan 100 and the installation surface. A rod section 128 of the resting pad 125 has a conical section 130 that will deform as the resting pad 125 is inserted from underneath the drain pan 100 and will prevent the resting pad 125 from falling out after insertion.

As shown in FIGS. 1, 6 and 8, the drain pan 100 may also be molded to include a foot 131 for an additional resting pad 125 outside the wall portion 110 of the drain pan 100 and below the blower 2 in order to counter possible imbalance created by the weight of the blower 2. The air conditioner 1 can be further stabilized above the installation surface using mounting clip assemblies (FIGS. 1 and 15B) that engage the drain pan 100 while being affixed to the installation surface by way of screws. The mounting clip assemblies may comprise an engaging clip 132 and a support 133. The support 133 may include a vibration absorbing means, made of elastic material such as rubber, and a cylindrical sleeve, made of rigid material such as metal. The sleeve is found within the vibration absorbing means and limits the extent of compression by the vibration absorbing means. The mounting clip assemblies may be moved along the vertical wall portion 110 to any spot on the perimeter of the drain pan 100 in order to place the mounting clip assembly above an appropriate installation surface such as one that is sufficiently rigid.

Figure 16:
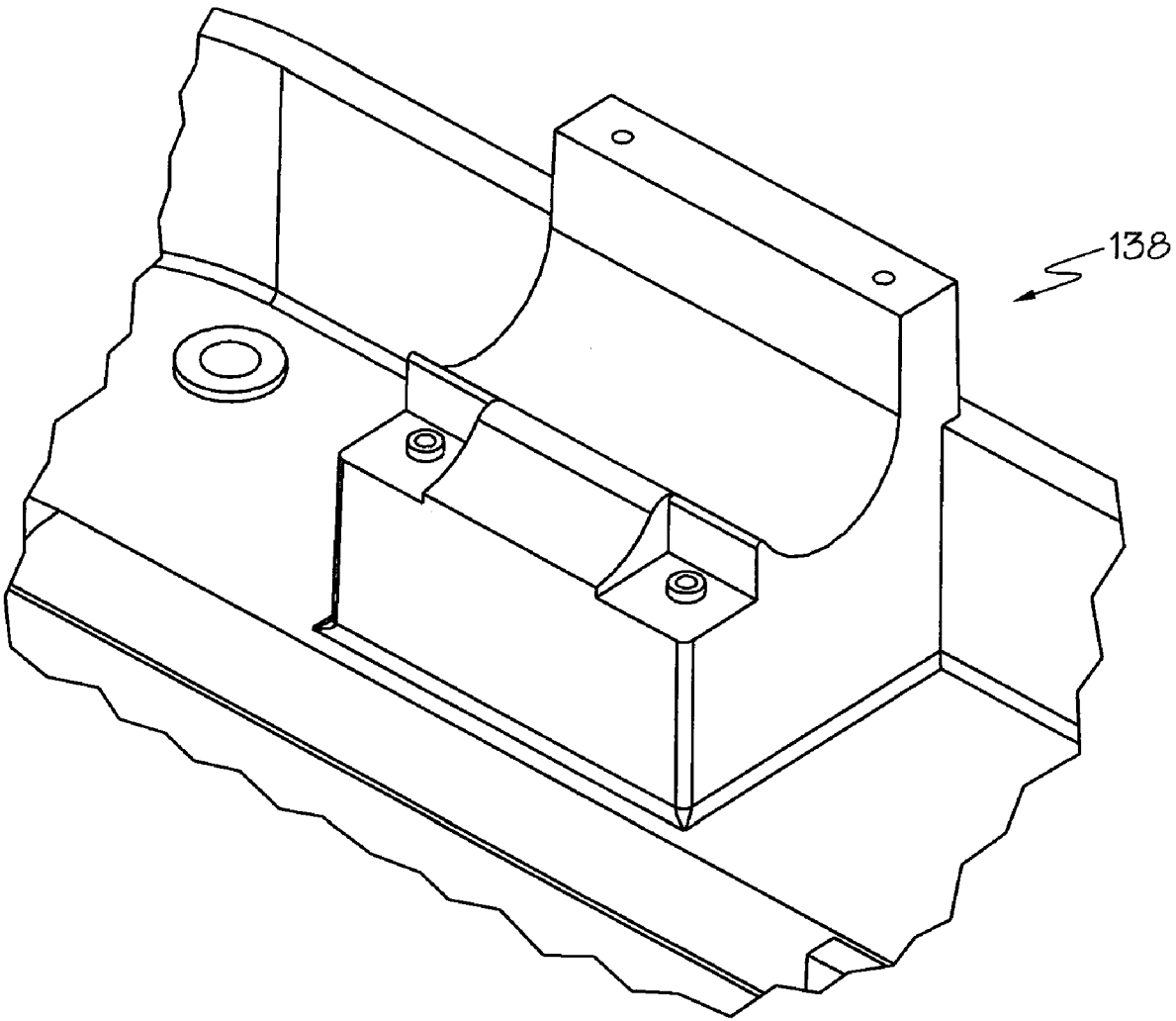
FIG. 16 is a close-up view of a pedestal of the drain pan.
Figure 17:
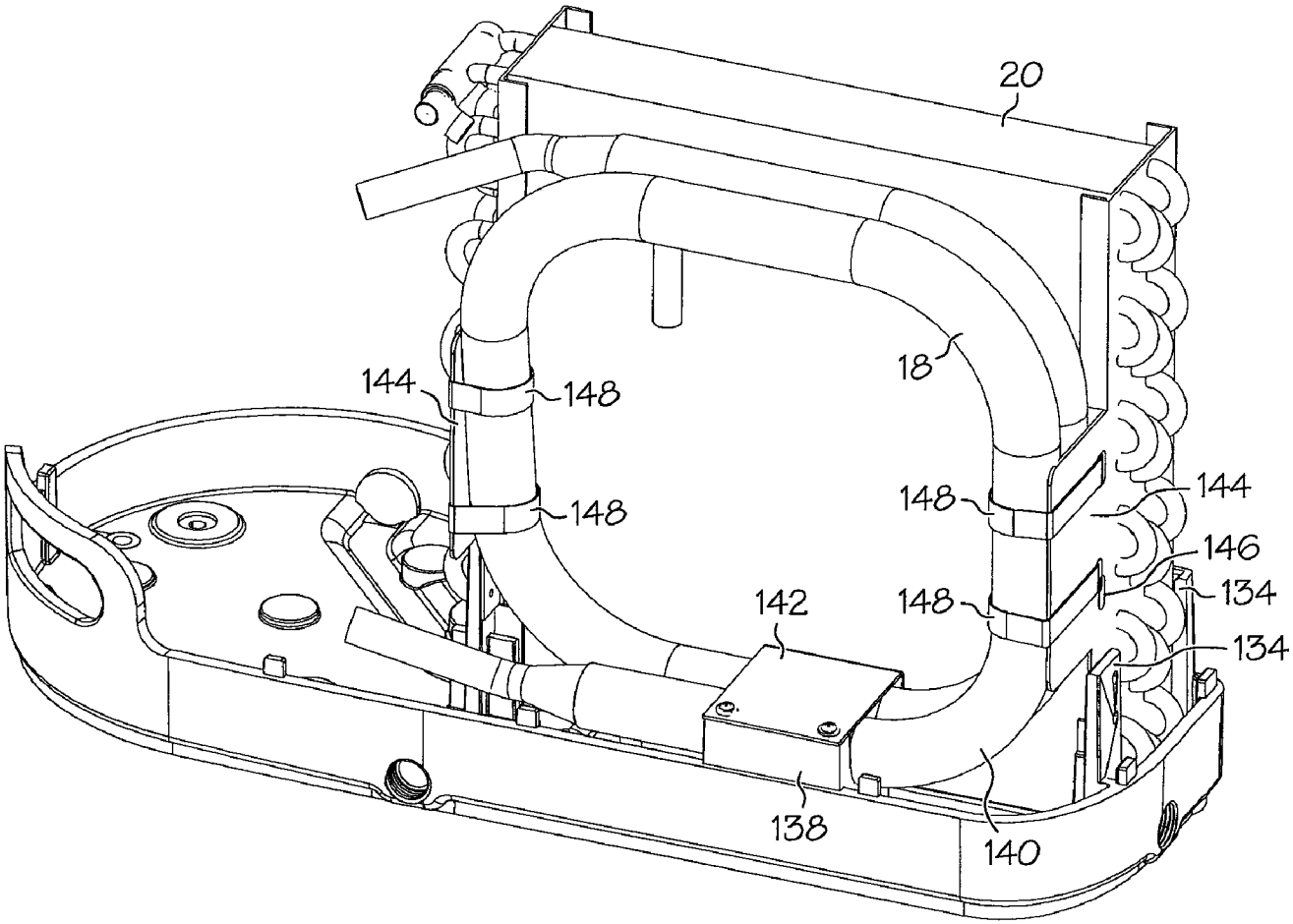
FIG. 17 is a view of a condenser and an evaporator mounted substantially vertically on the drain pan.

The drain pan 100 may further be molded to accommodate the mounting of the air conditioning components. As shown in FIGS. 6-7 and 17, in this embodiment, the drain pan 100 includes four posts 134 integrally projecting from the drain pan 100 and partly delineating a perimeter in which the evaporator 20 with corresponding dimensions can be placed. The posts 134 also include apertures 136 for fastening the evaporator 20 or neighboring parts to the drain pan 100 via means such as screws. The posts 134 help stabilize the vertical mounting of the evaporator 20. Adjacent to the posts 134, the drain pan 100 is molded to include an integral pedestal 138 (FIGS. 16-17) that holds loops 140 of a tubular element that comprises the condenser 18. As shown in FIG. 17, once the condenser 18 is placed on the pedestal 138, a condenser bracket 142 is placed over the loops 140 and is fastened onto the pedestal 138 via screws to hold the condenser 18 in place. In this embodiment, the width of the evaporator 20 is similar to the width of condenser 18. In such a case, the evaporator 20 may be equipped with plates 144 at its ends that include apertures 146 for condenser straps 148 to grip the loops 140 and additionally stabilize the condenser 18, as shown in FIG. 17.

Figure 19:
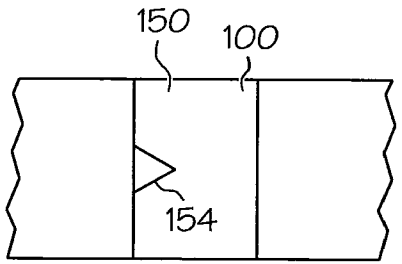
FIG. 19 is a sectional view of the drain pan through an aperture for a hex screw of the mounting assembly showing a rib.
Figure 18:
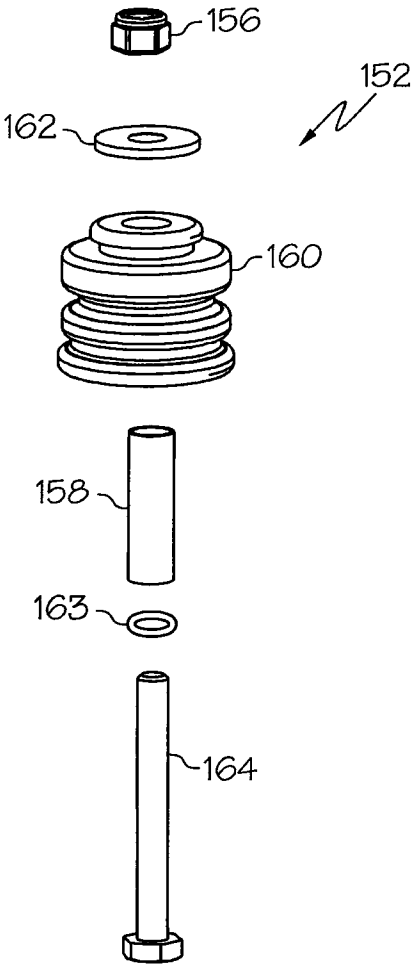
FIG. 18 is an exploded view of a mounting assembly for a compressor.
Figure 20:
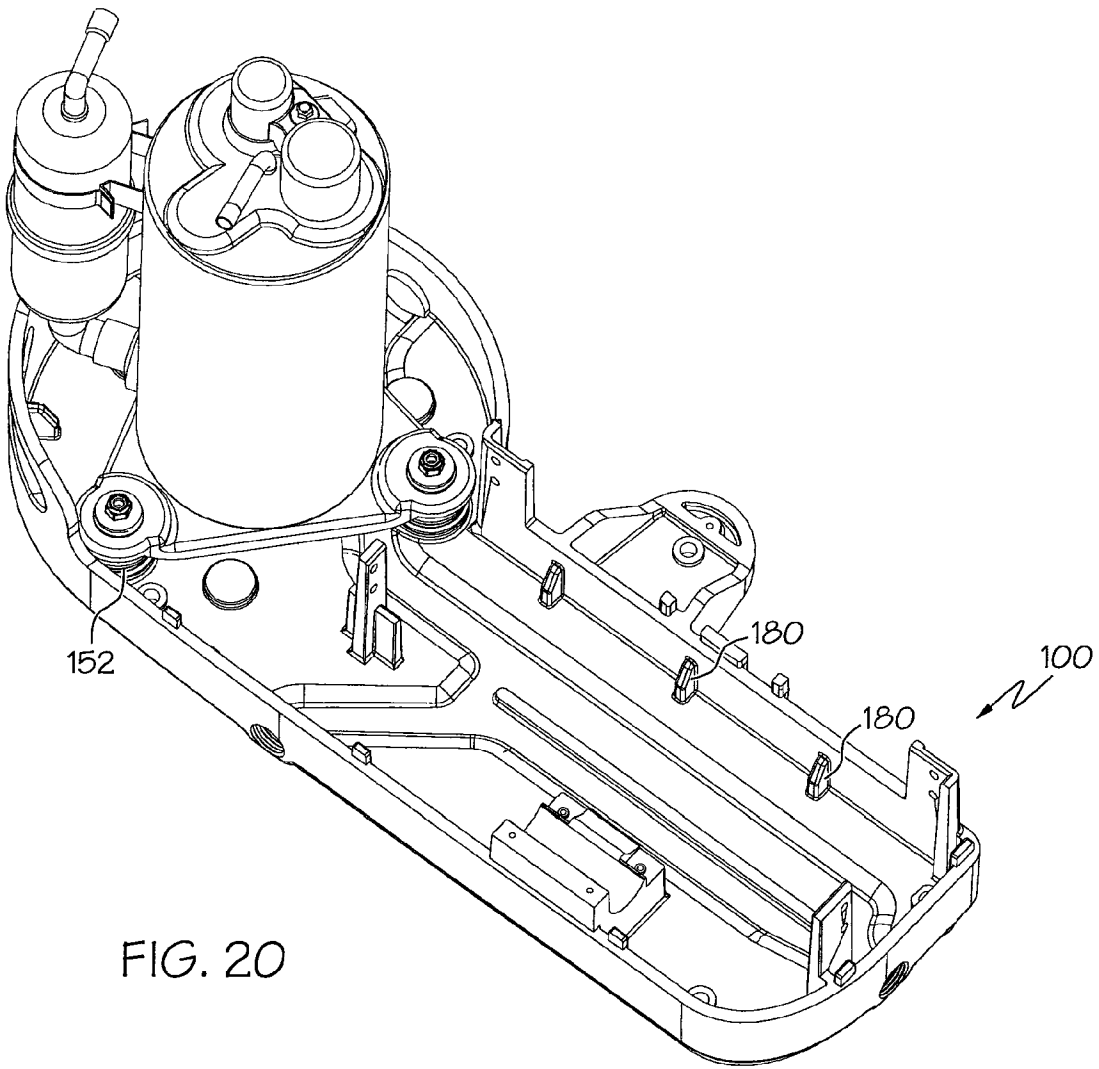
FIG. 20 is a perspective view of the compressor mounted on the drain pan using the mounting assembly.

As shown in FIGS. 8 and 20, the drain pan 100 further includes holes 150 for mounting assemblies 152 (FIG. 18) that support the compressor. The holes 150 of the drain pan 100 may include a rib 154 (FIG. 19) to prevent a hex cap screw 164 from falling out of the hole 150 during assembly. The rib 154 allows a user to carry the drain pan 100 around with the hex cap screw 164 inserted in the holes 150. As shown in FIG. 18, the mounting assembly 152 may be comprised of, for example, the hex cap screw 164, an O-ring 163, a tube 158, a grommet 160, a washer 162 and a nut 156 and fastens one of the feet of the compressor 16 to the drain pan 100. The O-ring 163 creates a water tight seal between the drain pan 100 and the hex cap screw 164. FIG. 20 shows the compressor 16 mounted on the drain pan 100 using the mounting assembly 152. As shown in FIG. 4, the drain pan 100 may further be molded to include a handle 166 to aid in transporting the air conditioner 1 where the covers have been removed.

The major components of the air conditioner 1 mounted on the drain pan 100 will be discussed in the following. As shown in FIGS. 3-4, the compressor 16 has a longitudinal axis that is substantially vertical contributing to the small footprint of the drain pan 100. The accumulator 34 is oriented in a way that its longitudinal axis is parallel to that of the compressor 16 also contributing the small footprint of the drain pan 100. The drain pan 100 is designed so that the accumulator 34 is substantially included in the space above the substantially circular portion 102 (FIGS. 9-10) of the footprint despite variations in the arrangement of the accumulator 34. The condenser 18 is made up of two coaxial tubes or coils (FIGS. 4 and 17). In such a tube-in-tube structure, an outer tube channels a refrigerant medium and is in fluid communication with the other components of the air conditioner 1. The inner tube (not shown) has a water outlet and a water inlet respectively connecting to outlet tube and inlet tube for circulating water from a body of water neighboring the nautical vehicle by means of a pump (not shown). The coaxial tubes form the loops whose dimensions are such that the condenser will closely fit between the plates 144 of the evaporator 20 (FIG. 17), and a reversing valve 22 (FIGS. 3-4) can be placed substantially within the loops 140 further contributing to a compact design of the air conditioner I by keeping the reversing valve 22 within the space above the footprint of the drain pan 100 (FIG. 9).

Figure 21:
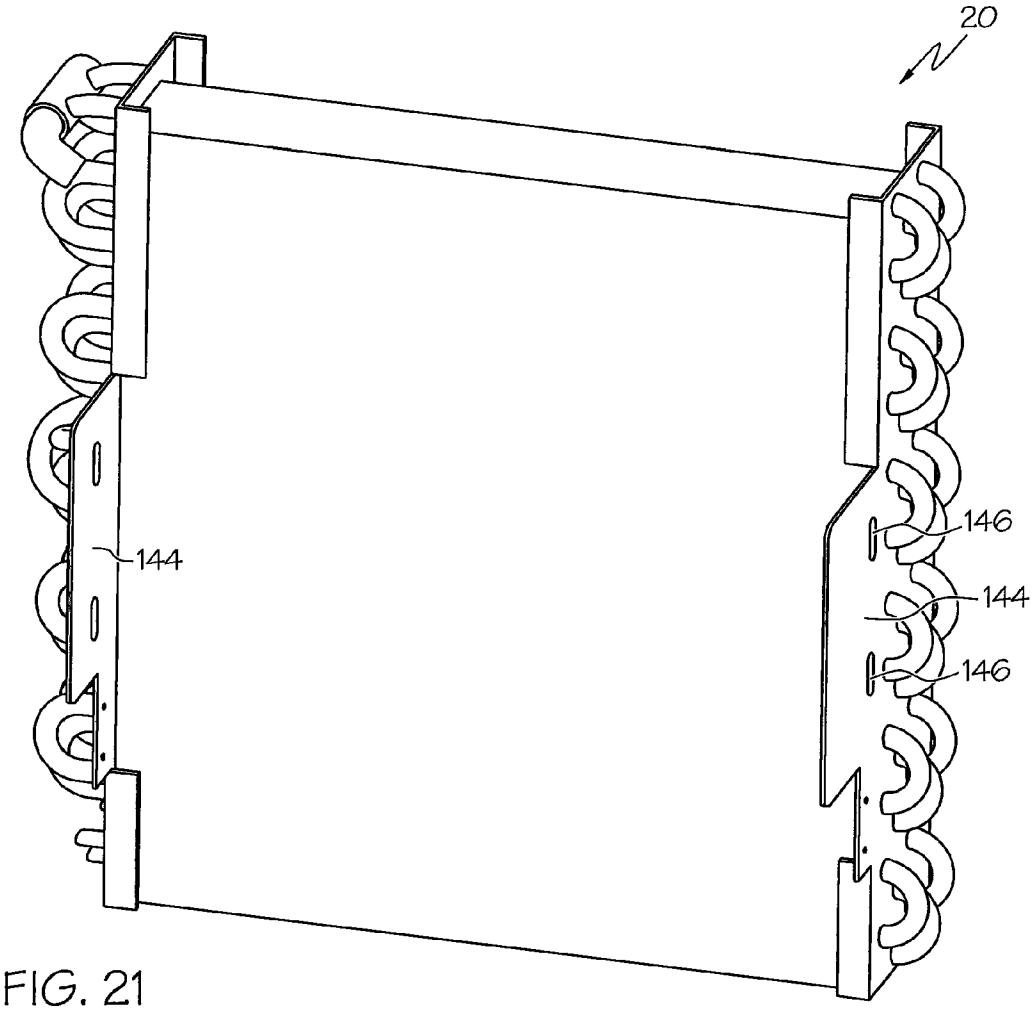
FIG. 21 is a view of the evaporator with end plates.

As shown in FIG. 21, in the present embodiment, the evaporator 20 is a bank of conduit in fluid communication with the outer tube (not shown) of the condenser 18 and is formed by routing the conduit multiple times through a set of parallel fins. The fins are placed between the plates and bent segments of the conduit protrude from the plates 144. In this embodiment, the plates 144 are similar in length but wider compared to the fins. The fins are positioned about the plates 144 so as to allow room for a filter 168 (FIG. 22) to be inserted between the plates 144 and the fins on a condenser side of the evaporator 20.

As shown in FIG. 8, the drain pan 100 can substantially be divided into a first mounting area 108*a* for the compressor, a second mounting area 108*b* for the evaporator, and a third mounting area 108*c* for the condenser. Thus, the drain pan 100 will be dimensionally limited to substantially span only the first, second, and third mounting areas 108*a*, 108*b*, and 108*c*. Moreover, the components are vertically mounted so as to minimize the mounting areas.

Figure 22:
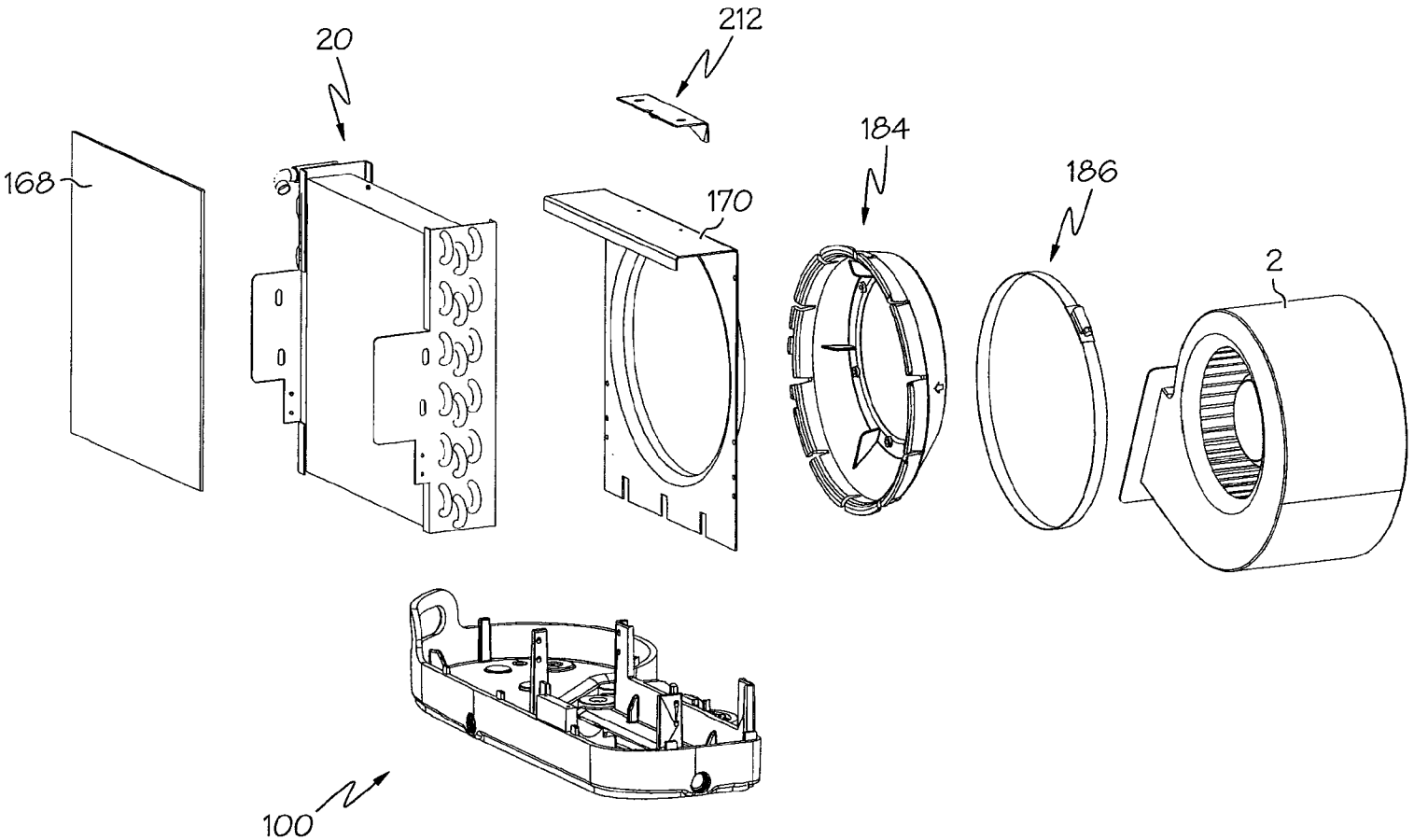
FIG. 22 is an exploded view of an assembly for connecting the blower to the air conditioner.
Figure 23:
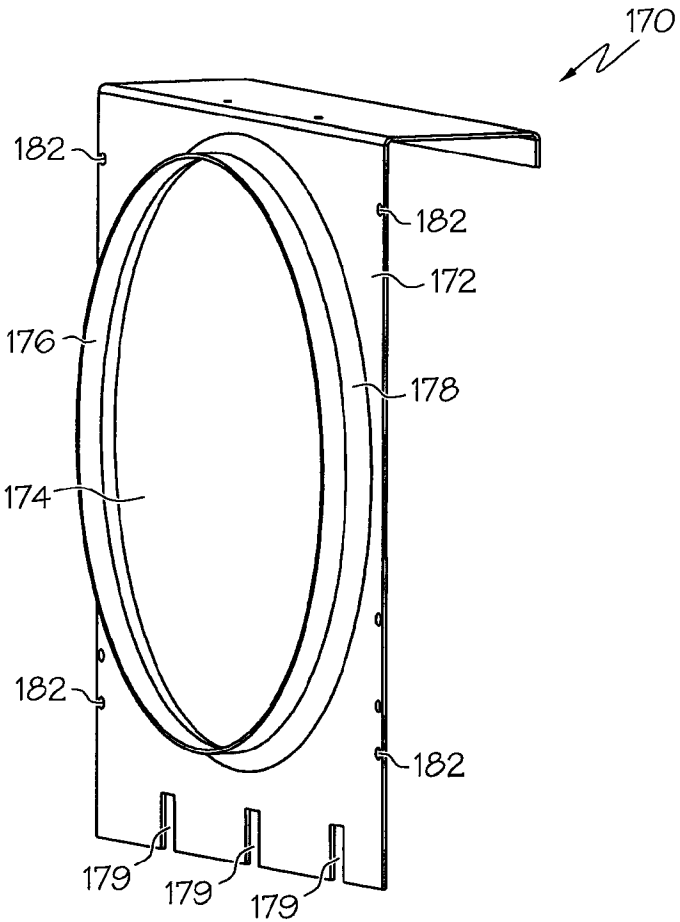
FIG. 23 is an isolated view of a guide cover of the assembly.

As shown in FIGS. 1 and 22-23, a fan duct plate or a guiding cover 170 is fastened to a blower side of the evaporator 20 and is a cover-like element that is placed on the top of the evaporator 20. The guiding cover 170 (FIG. 23) includes a flat section 172 with a circular opening 174 for directing air to the adjacent blower 2 and has a cylindrical section 176 extending from the opening 174. A curvature 178 is formed at the intersection of the flat section 172 and the cylindrical section 176 so that the flat section 172 is bent toward the blower 2 along the circumference of the opening 174 contributing to a smoother air flow. The flat section 172 further includes slots 179 at the bottom that mate with projections 180 (FIG. 20) on the drain pan 100. As shown in FIG. 1, the guiding cover 170 also includes apertures 182 for fastening it onto the plates 144 of the evaporator 20 and the posts 134 of the drain pan 100 by means of screws.

Figure 24B:
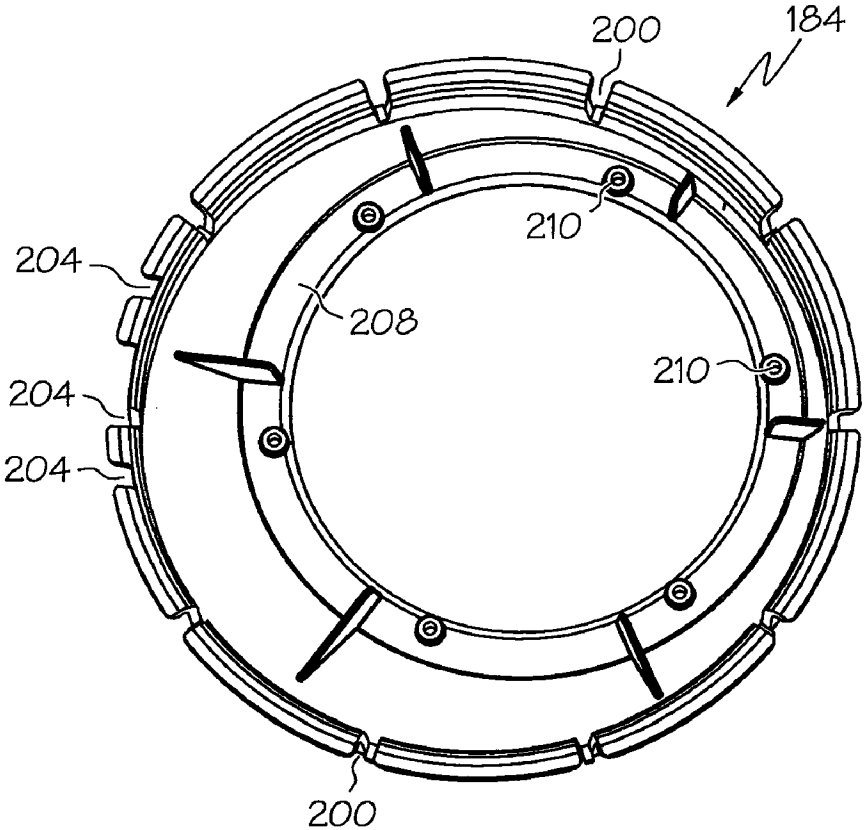
FIG. 24B is a rear perspective view of the duct element of the assembly.
Figure 24A:
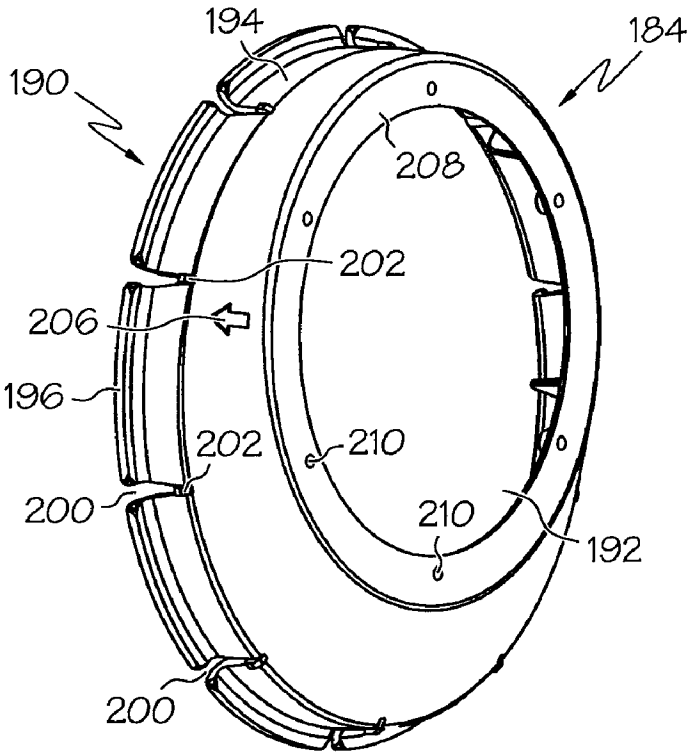
FIG. 24A is a front perspective view of a duct element of the assembly.
Figure 25:
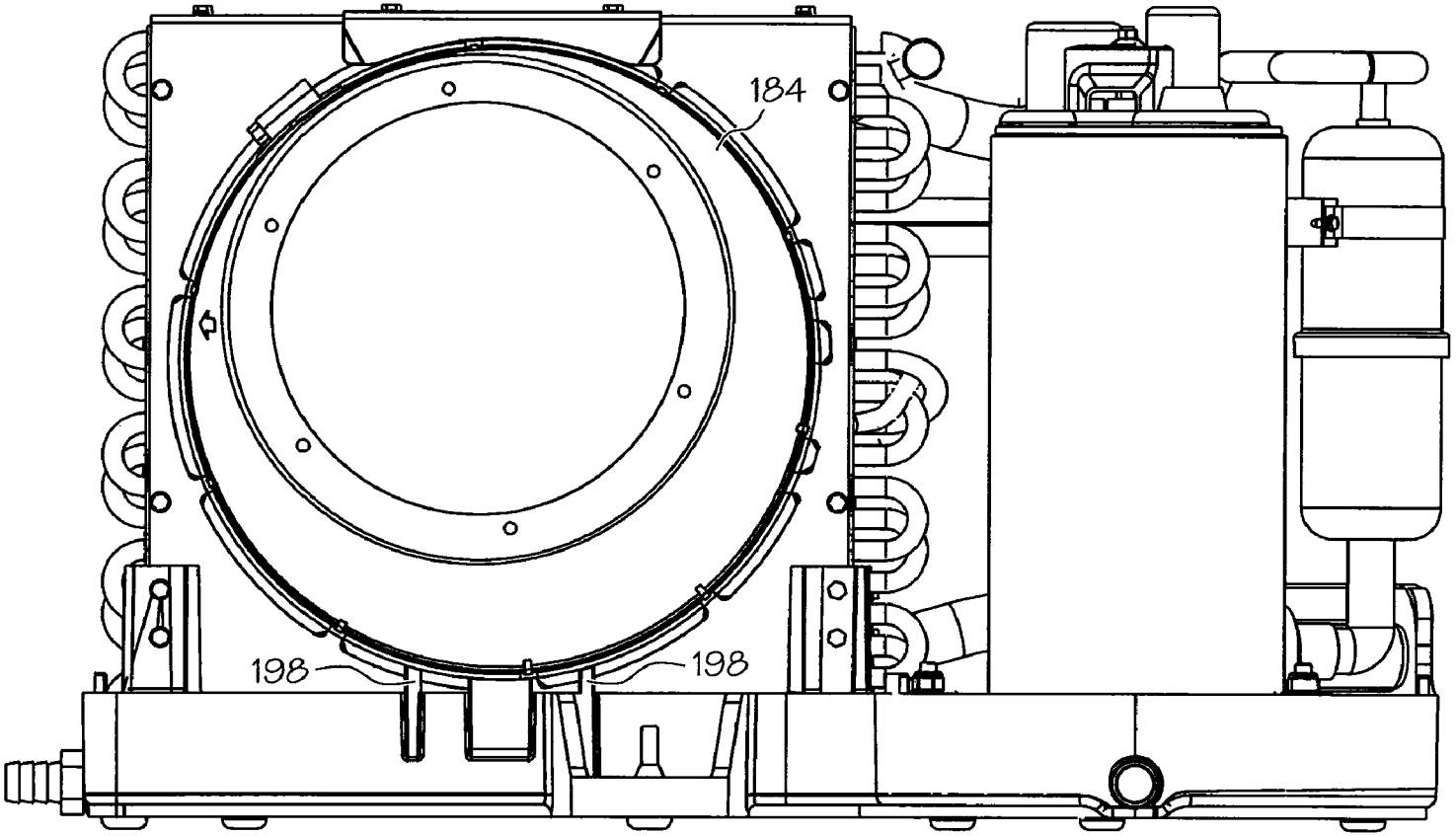
FIG. 25 is a rear view of the air conditioner without the blower showing the duct element on the guide cover.
Figure 26:
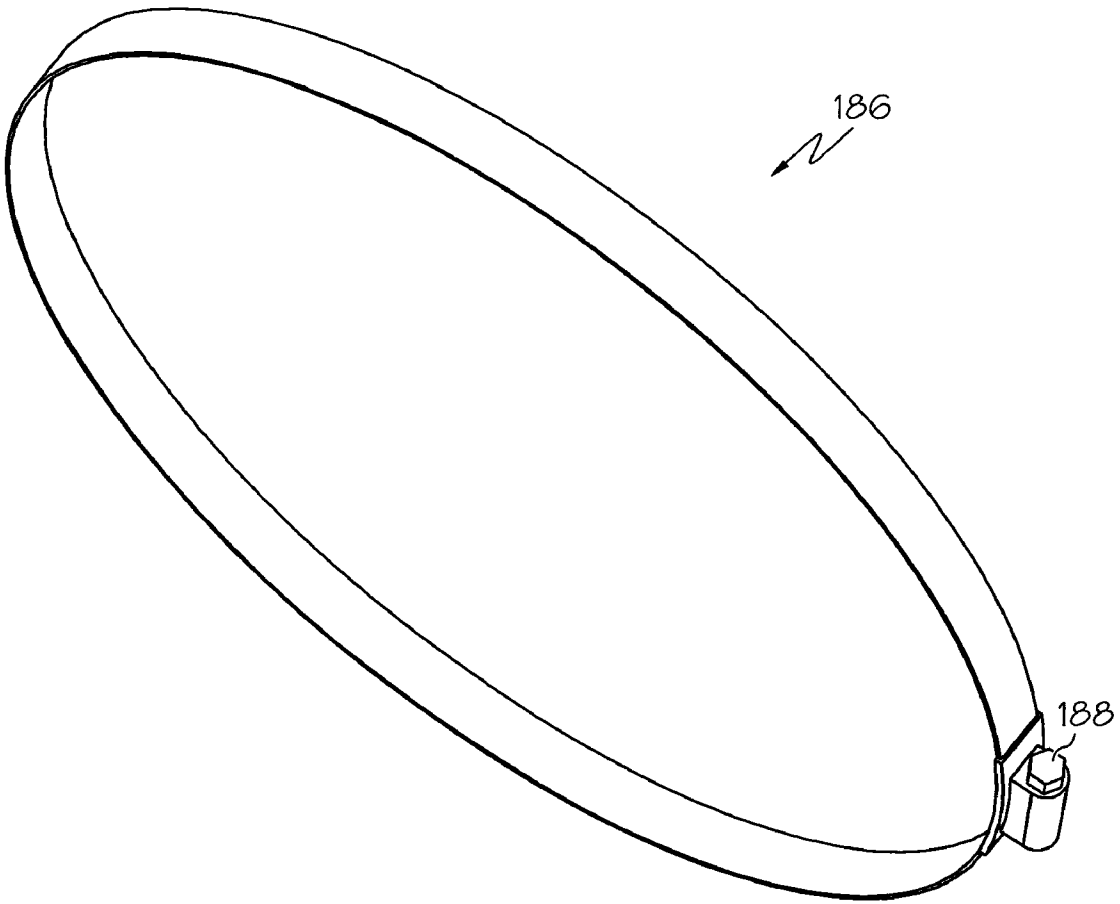
FIG. 26 is a view of a clamp element of the assembly.
Figures 1, 30A:
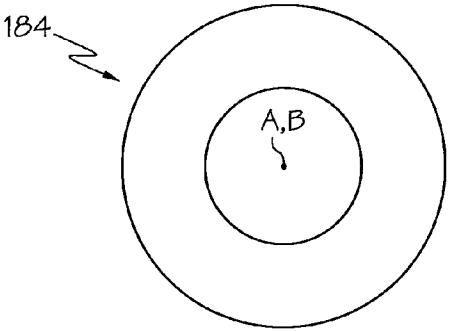
Figures 2, 30A:
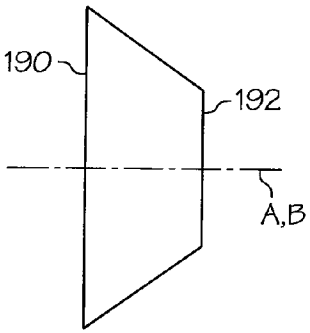
Figures 1, 30B:
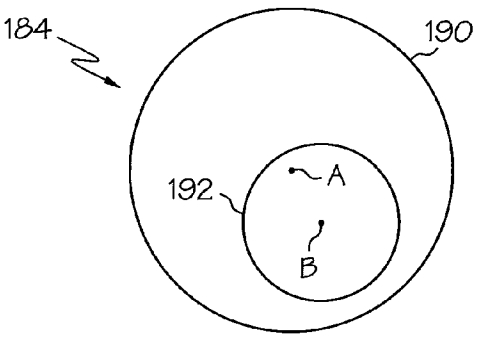
Figures 2, 30B:
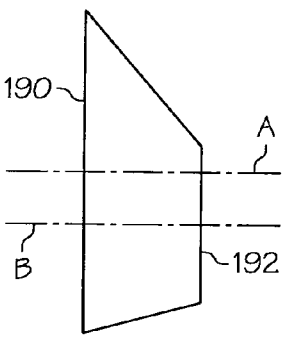

As shown in FIGS. 22 and 25, a fan duct transition or a duct element 184 is placed between the guiding cover 170 and the blower 2 by clamping it around the cylindrical section 176 of the guiding cover 170 with a band clamp or a clamp element 186 whose perimeter is controllable through an adjustment screw 188 that can tighten or-loosen. In the present embodiment, the clamp element 186 (FIG. 26) is metallic but it may be non-metallic. The duct element 184 (FIGS. 24A and 24B) in the present embodiment can be substantially described as a conical cylinder in which the two parallel surfaces or bases 190, 192 are circles of different diameters and different center axes as shown in FIGS. 24A and 30B. On the evaporator side of the duct element 184 is a non-tapered, cylindrical portion 194 which mates with the cylindrical section 176 of the guiding cover 170. The cylindrical portion 194 ends with an outwardly projecting flange 196 that rests against the guiding cover 170 and helps prevent separation of the duct element 184 from the guiding cover 170 after the clamp element 186 is placed around the cylindrical portion 194. The curvature 178 in the perimeter of the opening 174 of the guiding cover 170 is shaped to correspond to the part of the duct element 184 that abuts the guiding cover 170.

Figure 27:
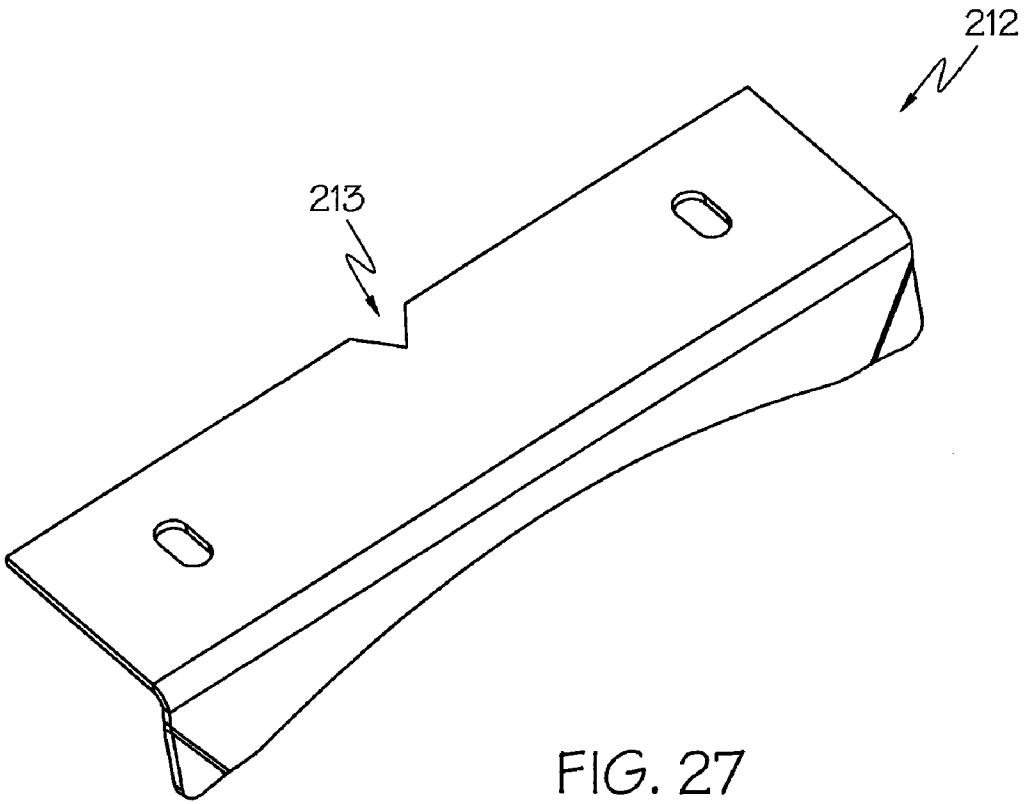
FIG. 27 is a view of a transition bracket of the assembly.

As shown in FIG. 25, the outwardly projecting flange 196 also interacts with first engaging elements 198 (FIGS. 6 and 25) on the vertical wall portion 110 of the drain pan 100 to secure the lower part of the duct element 184 between the first engaging elements 198 and the guiding cover 170 and to prevent the duct element 184 from falling off of the guiding cover 170 easily. As shown in FIGS. 24A and 24B, the cylindrical portion 194 has a plurality of indentations 200 scattered around the perimeter which allow for elastic deformation of the cylindrical portion 194 when the clamp element 186 is placed. There are radially outward protrusions 202 (FIG. 24B) adjacent to the depression of the indentations 200 that keep the clamp element 186 in place after it is tightened around the cylindrical portion 194. The outwardly projecting flange 196 also includes peripherally located, elongate pass portions 204 whose shapes correspond with those of first engaging elements 198 (FIGS. 24A-24B and 25). The pass portions 204 are found on the duct element 184 radially opposite a first marking 206. The first marking 206 may be a raised portion in the shape of an arrow on the duct element 184. When the first marking 206 is rotated to its highest position so that the arrow is opposite a second marking 213, the first engaging elements 198 can pass through the pass portions 204 thereby helping the mounting and demounting of the duct element 184 onto the guiding cover 170, as shown in FIG. 25. The second marking 213 may be a V-shaped notch (FIG. 27) on a transition bracket 212. The removal of the duct element 184 from the guiding cover 170 is made possible only at this position of the duct element 184.

On the blower side of the duct element 184 is an inwardly projecting flange 208 (FIGS. 24A and 24B) with apertures 210 for coupling the duct element 184 onto the blower 2.

As shown in FIGS. 22, 25, 27 and 29, the transition bracket or a second engaging element 212 (FIG. 27) is fastened to the guiding cover 170 and covers a part of the top of the guiding cover 170 and a part of the outwardly projecting flange 196 in order to secure the blower 2 to the guiding cover 170 and prevent the blower 2 from falling off when the orientation of the blower 2 is rotatably adjusted. The blower 2 is coupled to the evaporator 20 by fastening the duct element 184 onto the blower 2 by loosely screwing the transition bracket 212 over the guiding cover 170, inserting the outwardly projecting flange 196 adjacent to the arrow 206 into the transition bracket 212, passing the first engaging elements 198 through the pass portions 204, rotating the duct element 184 to obtain the desired orientation for the blower 2, clamping the duct element 184 onto the guiding cover 170 using the clamp element 186 and tightening the screws of the transition bracket 212. A different embodiment of the transition bracket 212 may be configured to pass through the pass portion 204 rather than the first engaging element 198.

Figure 28:
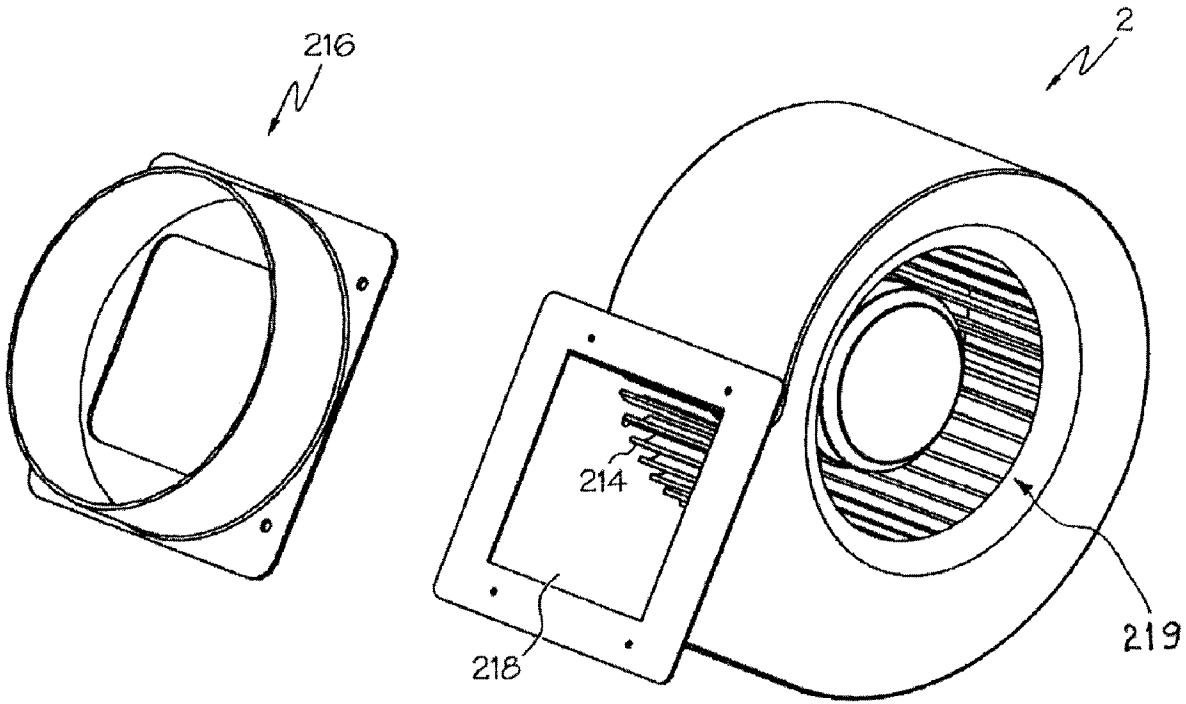
FIG. 28 is a view of the blower and a duct collar removed from the blower.

In FIG. 1, the air conditioner 1 can largely be divided into a main body 4 and the blower 2. The main body 4 comprises the drain pan 100 and what is mounted above it. In this embodiment, the blower 2 (FIG. 28) is a centrifugal fan but other types of fans, such as an axial fan with an air outlet oriented to a certain direction, or any other air moving devices are also contemplated with this invention. As shown in FIGS. 30A-1 through 30B-2, the blades 214 of the blower 2 rotate about a first axis B while the blower 2 itself can be rotated about a second axis A with respect to the main body 4. These first and second axes B and A are substantially parallel and spaced apart (FIG. 30B) in the present embodiment but, in other embodiments, they may be non-parallel (FIG. 30D) or identical (FIG. 30A). As shown in FIG. 28, a duct collar 216 is coupled to an outlet 218 of the blower 2 and can further connect with a plenum attachment (not shown). FIG. 28 also shows an inlet 219 of the blower 2.

Figure 29:
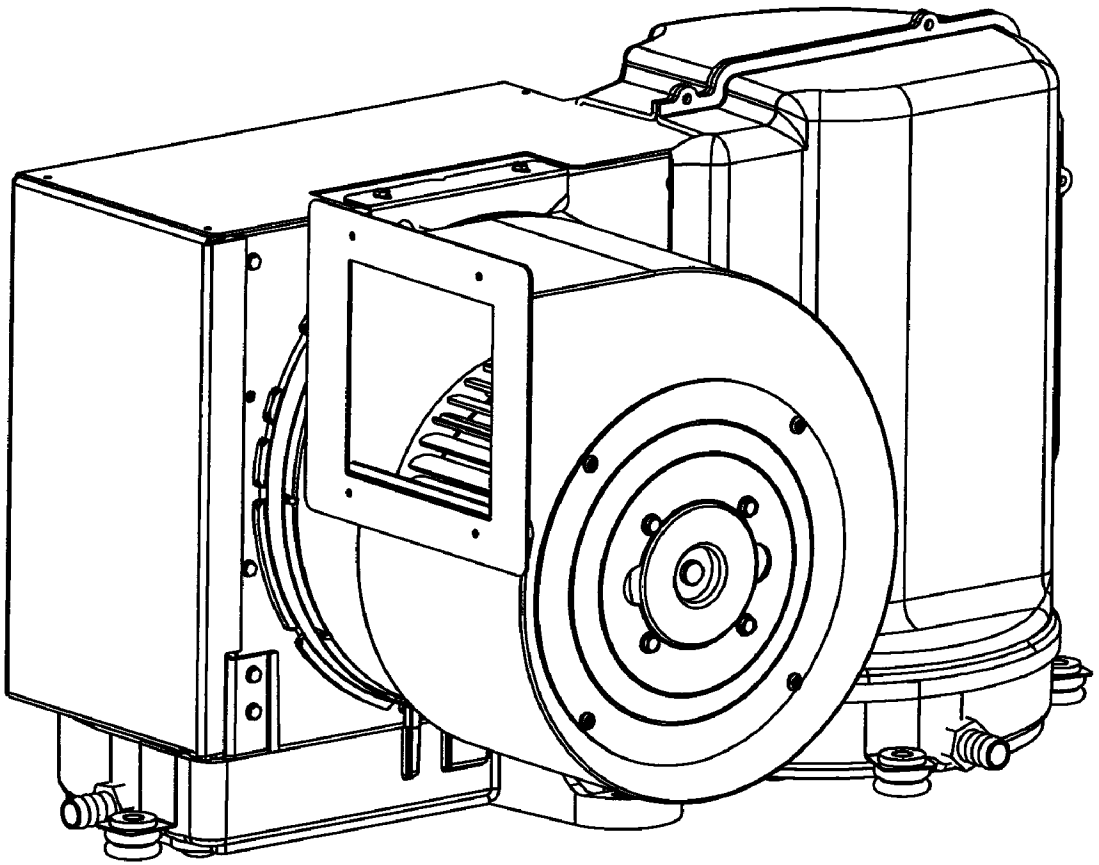
FIG. 29 is a perspective view of the air conditioner with the blower oriented differently from FIG. 1.

As shown in FIGS. 1 and 29, by rotating the blower 2 and the duct element 184, the orientation of the outlet 218 of the blower 2 of the present invention can be altered and can vary by more than 270 degrees. In particular, FIG. 1 shows that the blower 2 can be rotated toward the compressor 16 until the outlet 218 is obstructed by a bulging portion of the supply side cover 10 near the drain pan 100. The rotation of the blower 2 is not hindered by the air conditioning components and, in this embodiment, the compressor 16. As a result, the blower 2 can easily be connected with ducts approaching the air conditioner 1 from various angles, such as from either lateral side (FIG. I or FIG. 29) or top of the air conditioner 1. The lateral sides refer to opposing sides with respect to a vertical plane such as left and right. When the blower 2 is rotated from one direction to another direction about the second axis A, the directions may point to two different lateral sides such as the left and right of the air conditioner 1. However, the two directions are not necessarily opposite one another. For example, the two directions may form a 90-degree angle, one pointing to the left of a vertical plane and the other pointing to the right of a vertical plane in FIGS. 1 and 29, and these are deemed point to substantially different lateral sides of the air conditioner 1 although not in opposite directions.

The orientation of the outlet 218 of the blower can be altered simply by loosening the clamp element 186, rotating the duct element 184 to the desired orientation and tightening the clamp element 186. The rotation of the blower duct element 184 occurs continuously without interference or break. Thus, the orientation of the outlet 218 can be easily altered in a matter of seconds.

The non-concentric cylinder shape of the duct element 184 (FIGS. 24A, 24B and 25) is designed to limit the overall height of the air conditioner 1. Since it is possible for the outlet 218 of the blower 2 to substantially increase the height of the air conditioner 1 when the outlet 218 is located near the top of the air conditioner 1, the blower 2 and the duct element 184 are attached at a predetermined orientation relative to one another such that the maximum height of the air conditioner 1 will be kept below a certain value despite various orientations of the blower 2. One way to do this is by attaching the blower 2 to duct element 184 so that, when axis B (FIG. 30B-1) is at its lowest relative to axis A, the blower 2 is oriented to reach its vertically longest position. As shown in FIG. 30B, the blades of the blower 2 rotate around B while the blower 2 is rotated with respect to the air conditioner 1 around A. The overall height of the air conditioner 1 with the rotatable blower 2 will change depending on how the blower 2 is fastened in relation to the duct element 184. Therefore, the maximum height of an air conditioner 1 can be restricted by adjusting the orientation in which the blower 2 is fastened to the duct element 184. Moreover, the conical cylinder shape of the duct element 184 and the curvature 178 of the guiding cover 170 contribute to a smoother air flow within the air conditioner 1.

Figures 2, 30C:
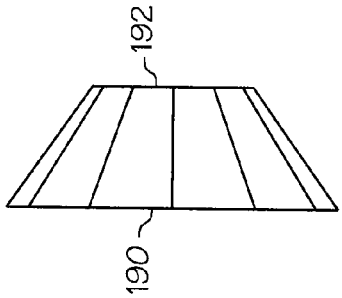
Figures 1, 30C:
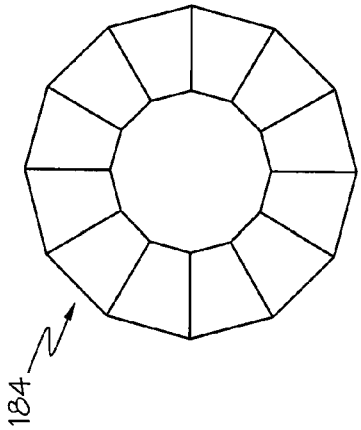
Figure 30D:
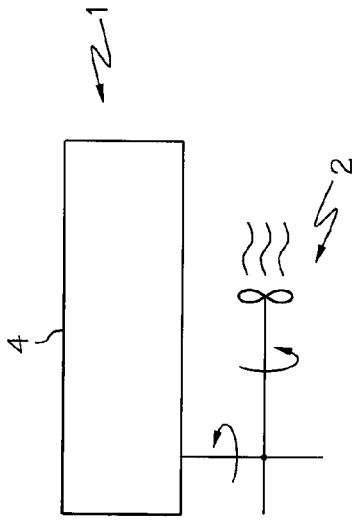
FIG. 30D is a schematic illustration of a first axis and a second axis in non-parallel relation to one another.

In the present embodiment, the adjustment of the blower orientation occurs through a sliding mechanism. However, it is possible for the parallel surfaces or bases 190, 192 of the duct element 184 to be non-circular and, for example, may be polygonal (FIG. 30C). In that case, the adjustment of the duct element 184 around the guiding cover 170 may not occur through sliding. For example, it may be necessary to adjust the orientation of the blower 2 after completely removing the duct element 184 from the guiding cover 170. Moreover, in such case, the clamp element 186 will not be circular either and, for example, may be polygonal. Furthermore, it is also possible for the duct element 184 to be non-tapered or for the bases 190, 192 of the duct element 184 to be concentric.

The covers for the air conditioner 1 can be placed after all of the interior components are mounted and operatively connected, and can be easily removed to allow access for servicing of components.

The invention has been described with reference to the example embodiments described above. Modifications and alterations will occur to others upon a reading and understanding of this specification. Example embodiments incorporating one or more aspects of the invention are intended to include all such modifications and alterations.

What is claimed is:

1. An air conditioning device for a nautical vehicle including:

a main body; and a blower including an inlet and an outlet, the inlet being in air communication with the main body, the blower further including blades rotating therewithin about a first axis, and an assembly for adjusting the blower with respect to the main body about a second axis so as to alter an orientation of the outlet, the assembly including a guiding cover and a cylindrical duct element for maintaining the main body and the blower in air communication with one another, the duct element having a first base and a second base, and coupled to the blower at the second base, the first base of the duct element dimensioned to correspondingly fit the guiding cover, and the duct element being rotatably adjustable around the guiding cover about the second axis at the first base so as to alter the orientation of the outlet.

2. The air conditioning device of claim 1, wherein the first and second axes are substantially parallel.

3. The air conditioning device of claim 2, wherein the first and second axes are identical.

4. The air conditioning device of claim 1, wherein the blower is a centrifugal fan.

5. The air conditioning device of claim 1, the bases being circular and the duct element being slidingly adjustable around the guiding cover about the second axis.

6. The air condidioning device of claim 1, the bases being non-circular and the duct element being non-slidingly adjustable around the guiding cover about the second axis.

7. The air conditioning device of claim 1, the first and second bases having unequal surface areas.

8. The air conditioning device of claim 7, the duct element being substantially tapered toward the blower.

9. The air conditioning device of claim 1, wherein the duct element can be axially divided into a tapered portion and a non-tapered portion, and a clamp element is placed around the non-tapered portion.

10. The air conditioning device of claim 9, wherein the clamp element is configured to have a variable perimeter for fastening the duct element to the guiding cover.

11. The air conditioning device of claim 9, wherein the orientation of the blower is altered by loosening and tightening of the clamp element.

12. The air conditioning device of claim 9, wherein the non-tapered portion includes peripherally scattered indents to accommodate elastic deformation of the non-tapered portion when the clamp element is placed.

13. The air conditioning device of claim 9, the duct element including an outwardly projecting flange at the first base, the flange including a peripherally located pass portion, and the main body further including a first engaging element and a second engaging element, wherein the flange of the duct element is removably held by the first and second engaging elements, and wherein the duct element is removed by rotating the duct element so that one of the engaging elements can pass through the pass portion.

14. The air conditioning device of claim 13, wherein the duct element includes protrusions that are located peripherally on the non-tapered portion so that the clamp element can be secured between the flange and the projections.

15. The air conditioning device of claim 13, the pass portion allowing removal of the duct element from the main body only at a predetermined orientation of the duct element.

16. The air conditioning device of claim 15, wherein the predetermined orientation is indicated by the alignment of a first marking and a second marking.

17. The air conditioning device of claim 1, wherein the blower is installed with respect to the duct element so that the maximum height of the air conditioning device is limited.

18. An air conditioning device for a nautical vehicle including: a main body; and a blower including an inlet and an outlet, the inlet being in air communication with the main body, the blower being rotatable about first axis so that the outlet can be oriented toward a first directon and a second direction, and the first and second directions point to substantially different lateral sides of the main body, and an assembly for adjusting the blower with respect to the main body about a second axis so as to alter an orientation of the outlet, the assembly including a guiding cover and a cylidrical duct element for maintaining the main body and the blower in air communication with one another, the duct element having a first base and a second base, and coupled to the blower at the second base, the first base of the duct element dimensioned to correspondingly fit the guiding cover, and the duct element being rotatbly adjustable around the guiding cover about the second axis at the first base so as to alter the orientation of the outlet.

19. The air conditioning device of claim 18, wherein the first direction and the second direction point to substantially opposite directions.

20. The air conditioning device of claim 19, wherein the blower can be rotated without interference from a compressor, an evaporator or a condenser.

21. The air conditioning device of claim 18, wherein the blower is rotatable by more than 270 degrees.

22. The air conditioning device of claim 18, wherein the air conditioning device further includes a clamp element for maintaining the blower oriented with respect to the main body, and wherein only loosening of the clamp element is necessary to change orientation of the blower.

23. A method for installing an air conditioning device for a nautical vehicle: the air conditioning device including a main body; a blower including an inlet and an outlet, the inlet being in air communication with the main body, the blower further including blades rotating there within about a first axis, the method including the steps of: providing a clamp element; providing an assembly for adjusting the blower with respect to the main body about a second axis so as to alter an orientation of the outlet, the assembly including a guiding cover and a cylindrical duct element for maintaining the main body and the blower in air communication with one another, the duct element having a first base and a second base, and coupled to the blower at the second base, the first base of the duct element dimensioned to correspondingly fit the guiding cover, and the duct element being rotatably adjustable around the guiding cover about the second axis at the first base so as to alter the orientation of the outlet; orienting the outlet of the blower to a desired direction by hand through rotation about the second axis; and tightening the clamp element to maintain the blower oriented with respect to the main body.

* * * * *